US010933963B2

(12) United States Patent
Bylsma et al.

(10) Patent No.: US 10,933,963 B2
(45) Date of Patent: Mar. 2, 2021

(54) METHOD FOR CONTROLLING A TRIM-TILT ANGLE OF A MARINE PROPULSION UNIT

(71) Applicant: BRP US INC., Sturtevant, WI (US)

(72) Inventors: Philip Bylsma, Brookfield, WI (US); Benjamin Jones, Saint Francis, WI (US)

(73) Assignee: BRP US INC., Sturtevant, WI (US)

( * ) Notice: Subject to any disclaimer, the term of this patent is extended or adjusted under 35 U.S.C. 154(b) by 71 days.

(21) Appl. No.: 16/121,062

(22) Filed: Sep. 4, 2018

(65) Prior Publication Data

US 2019/0071160 A1 Mar. 7, 2019

Related U.S. Application Data

(60) Provisional application No. 62/553,784, filed on Sep. 1, 2017.

(51) Int. Cl.
*B63H 20/10* (2006.01)
*B63H 20/08* (2006.01)

(52) U.S. Cl.
CPC ..... *B63H 20/10* (2013.01); *B63H 20/08* (2013.01)

(58) Field of Classification Search
CPC ..... B63H 20/10; B63H 20/08
USPC ..... 701/21
See application file for complete search history.

(56) References Cited

U.S. PATENT DOCUMENTS 5,195,914 A 3/1993 Binversie et al.
6,220,905 B1 4/2001 Blanchard
7,156,709 B1 * 1/2007 Staerzl ..... B63H 20/10 440/61 G
7,416,456 B1 * 8/2008 Gonring ..... B63H 20/10 440/1
7,736,206 B1 6/2010 McChesney et al.
8,150,569 B2 * 4/2012 Kaji ..... G05D 1/0206 114/144 E
9,290,252 B1 * 3/2016 Tuchscherer ..... B63H 20/08
9,463,858 B1 * 10/2016 Remmers ..... B63H 20/10
2011/0281477 A1 * 11/2011 Inoue ..... F02D 31/002 440/1
2011/0294370 A1 * 12/2011 Kuriyagawa ..... B63H 20/10 440/1
2016/0251066 A1 * 9/2016 Hiroshima ..... B63H 3/10 701/21

(Continued)

*Primary Examiner* — Hunter B Lonsberry
*Assistant Examiner* — Elizabeth Yang
(74) *Attorney, Agent, or Firm* — BCF, LLP

(57) ABSTRACT

A method for controlling a trim-tilt angle of a propulsion unit of a marine outboard motor. The method includes: receiving a request to increase the trim-tilt angle of the propulsion unit; determining a motor operation parameter; determining the trim-tilt angle of the propulsion unit; prior to increasing the trim-tilt angle in response to the request, determining if the propulsion unit is in a trim limit condition; increasing the trim-tilt angle of the propulsion unit in response to the request when the propulsion unit is determined not to be in the trim limit condition; and one of maintaining the trim-tilt angle of the propulsion unit and stopping increase of the trim-tilt angle of the propulsion unit when the propulsion unit is determined to be in the trim limit condition. A method for controlling the trim-tilt angle in view of an over-trim condition of the propulsion unit is also disclosed.

22 Claims, 13 Drawing Sheets

(56) References Cited

U.S. PATENT DOCUMENTS

2018/0050779 A1* 2/2018 Anschuetz ..... B63H 20/10

* cited by examiner

METHOD FOR CONTROLLING A TRIM-TILT ANGLE OF A MARINE PROPULSION UNIT

CROSS-REFERENCE

The present application claims priority to U.S. Provisional Patent Application No. 62/553,784, filed on Sep. 1, 2017, the entirety of which is incorporated herein by reference.

FIELD OF TECHNOLOGY

The present technology relates to a method for controlling a trim-tilt angle of a marine propulsion unit.

BACKGROUND

A marine outboard motor generally comprises a bracket assembly that connects the drive unit of the marine outboard motor to the stern of a watercraft (e.g., a boat). The drive unit includes an internal combustion engine and a propulsion unit having a propeller. The marine outboard motor is typically designed so that the steering angle and the tilt/trim angles of the drive unit relative to the boat can be adjusted and modified as desired. The bracket assembly typically includes a swivel bracket carrying the drive unit for pivotal movement about a steering axis and a stern bracket supporting the swivel bracket and the drive unit for pivotal movement about a tilt/trim axis extending generally horizontally. The stern bracket is connected to the stern of the watercraft.

Managing the trim-tilt angle of the propulsion unit can have a significant effect on the watercraft's hydrodynamic properties and improper positioning of the drive unit about the tilt/trim axis can have a negative effect on watercraft's stability. For example, running the motor at too high a speed with the drive unit at too high a tilt/trim angle can cause the propeller to ventilate and/or cause the bow to lift excessively. In addition, running the motor at too high a speed with the drive unit at too high a tilt/trim angle can damage the bracket assembly and running the motor with the propulsion unit out of the water can cause the engine to overheat.

Therefore there is a desire for a method for controlling a trim-tilt angle of a marine propulsion unit that addresses at least some of the drawbacks identified above.

SUMMARY

It is an object of the present technology to ameliorate at least some of the inconveniences present in the prior art.

According to an aspect of the present technology, there is provided a method for controlling a trim-tilt angle of a propulsion unit of a marine outboard motor. The propulsion unit is driven by a motor of the marine outboard motor. The method includes: receiving a request to increase the trim-tilt angle of the propulsion unit; determining a motor operation parameter of the motor; determining the trim-tilt angle of the propulsion unit; prior to increasing the trim-tilt angle in response to the request, determining if the propulsion unit is in a trim limit condition. The trim limit condition is characterized at least by the determined motor operation parameter being greater than a predetermined value of the motor operation parameter, and the trim-tilt angle being equal to or greater than a threshold trim out angle of the propulsion unit. The method also includes increasing the trim-tilt angle of the propulsion unit in response to the request when the propulsion unit is determined not to be in the trim limit condition.

The method also includes one of maintaining the trim-tilt angle of propulsion unit and stopping increase of the trim-tilt angle of the propulsion unit when the propulsion unit is determined to be in the trim limit condition In some implementations of the present technology, the method further includes notifying a user of the outboard motor when the propulsion unit is in the trim limit condition.

In some implementations of the present technology, notifying the user includes displaying a notification on a user interface of a watercraft provided with the outboard motor.

In some implementations of the present technology, the motor operation parameter is a position of a throttle input device. The predetermined value of the motor operation parameter is a predetermined position of the throttle input device. Determining the motor operation parameter includes sensing the position of the throttle input device using a throttle input device position sensor.

In some implementations of the present technology, the predetermined position of the throttle input device corresponds to a throttle request of the motor between 30% and 50% inclusively.

In some implementations of the present technology, the motor operation parameter is a motor speed of the motor. The predetermined value of the motor operation parameter is a predetermined motor speed. Determining the motor operation parameter comprises sensing the motor speed using a motor speed sensor.

In some implementations of the present technology, the predetermined motor speed is between 1500 and 3000 rpm inclusively.

In some implementations of the present technology, determining the trim-tilt angle includes sensing the trim-tilt angle using a trim-tilt sensor.

In some implementations of the present technology, the threshold trim out angle is between 15° and 25° inclusively.

In some implementations of the present technology, the threshold trim out angle is a full trim out angle of the propulsion unit.

In some implementations of the present technology, receiving the request to increase the trim-tilt angle includes receiving a signal from a trim-tilt control actuator indicative of a desired increase of the trim-tilt angle.

According to another aspect of the present technology, there is provided a method for controlling a trim-tilt angle of a propulsion unit of a marine outboard motor. The propulsion unit is driven by a motor of the marine outboard motor. The method includes: receiving a request to increase a motor operation parameter of the motor to a desired value of the motor operation parameter; determining a trim-tilt angle of the propulsion unit; prior to increasing the motor operation parameter to the desired value of the motor operation parameter in response to the request, determining if increasing the motor operation parameter to the desired value of the motor operation parameter would cause the propulsion unit to be in an over-trim condition. The over-trim condition is characterized at least by the desired value of the motor operation parameter being greater than a predetermined value of the motor operation parameter, and the trim-tilt angle being equal to or greater than a threshold trim out angle of the propulsion unit. The method also includes, when it is determined that increasing the value of the motor operation parameter to the desired value of the motor operation parameter would cause the propulsion unit to be in the over-trim condition: limiting the motor operation parameter to the predetermined value of the motor operation parameter; reducing the trim-tilt angle of the propulsion unit to equal to or less than the threshold trim out angle of the propulsion unit; and increasing the motor operation parameter to the desired value of the motor operation parameter after the trim-tilt angle is reduced to less than the threshold trim out angle. When it is determined that increasing the motor operation parameter to the desired value of the motor operation parameter would not cause the propulsion unit to be in the over-trim condition, the method includes increasing the motor operation parameter to the desired value of the motor operation parameter.

In some implementations of the present technology, the method also includes notifying a user of the outboard motor when increasing the motor operation parameter to the desired value of the motor operation parameter would cause the propulsion to be in the over-trim condition.

In some implementations of the present technology, notifying the user includes displaying a notification on a user interface of a watercraft provided with the outboard motor.

In some implementations of the present technology, the motor operation parameter is a position of a throttle input device. The predetermined value of the motor operation parameter is a predetermined position of the throttle input device. Receiving the request for increasing the motor operation parameter includes sensing the position of the throttle input device using a throttle input device position sensor.

In some implementations of the present technology, the predetermined position of the throttle input device corresponds to a throttle request of the motor between 30% and 50% inclusively.

In some implementations of the present technology, the predetermined position of the throttle input device corresponds to a throttle request of approximately 40%.

In some implementations of the present technology, the motor operation parameter is a motor speed. The desired value of the motor operation parameter is a desired motor speed. The predetermined value of the motor operation parameter is a predetermined motor speed.

In some implementations of the present technology, the predetermined motor speed is between 1500 and 3000 rpm inclusively.

In some implementations of the present technology, determining the trim-tilt angle includes sensing the trim-tilt angle using a trim-tilt sensor wherein the threshold trim out angle is between 15° and 25° inclusively.

In some implementations of the present technology, reducing the trim-tilt angle reduces the trim-tilt angle to less than the threshold trim out angle of the propulsion unit.

For purposes of this application, the terms related to spatial orientation such as forward, rearward, left, right, vertical, and horizontal are as they would normally be understood by a driver of a boat sitting thereon in a normal driving position with a marine propulsion unit mounted to a stern of the boat. Also, the term "trim in" refers to pivoting the marine propulsion unit about a horizontal tilt/trim axis toward the watercraft to which the marine propulsion unit is connected and the term "trim out" refers to pivoting the marine propulsion unit about the horizontal tilt/trim axis away from the watercraft.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
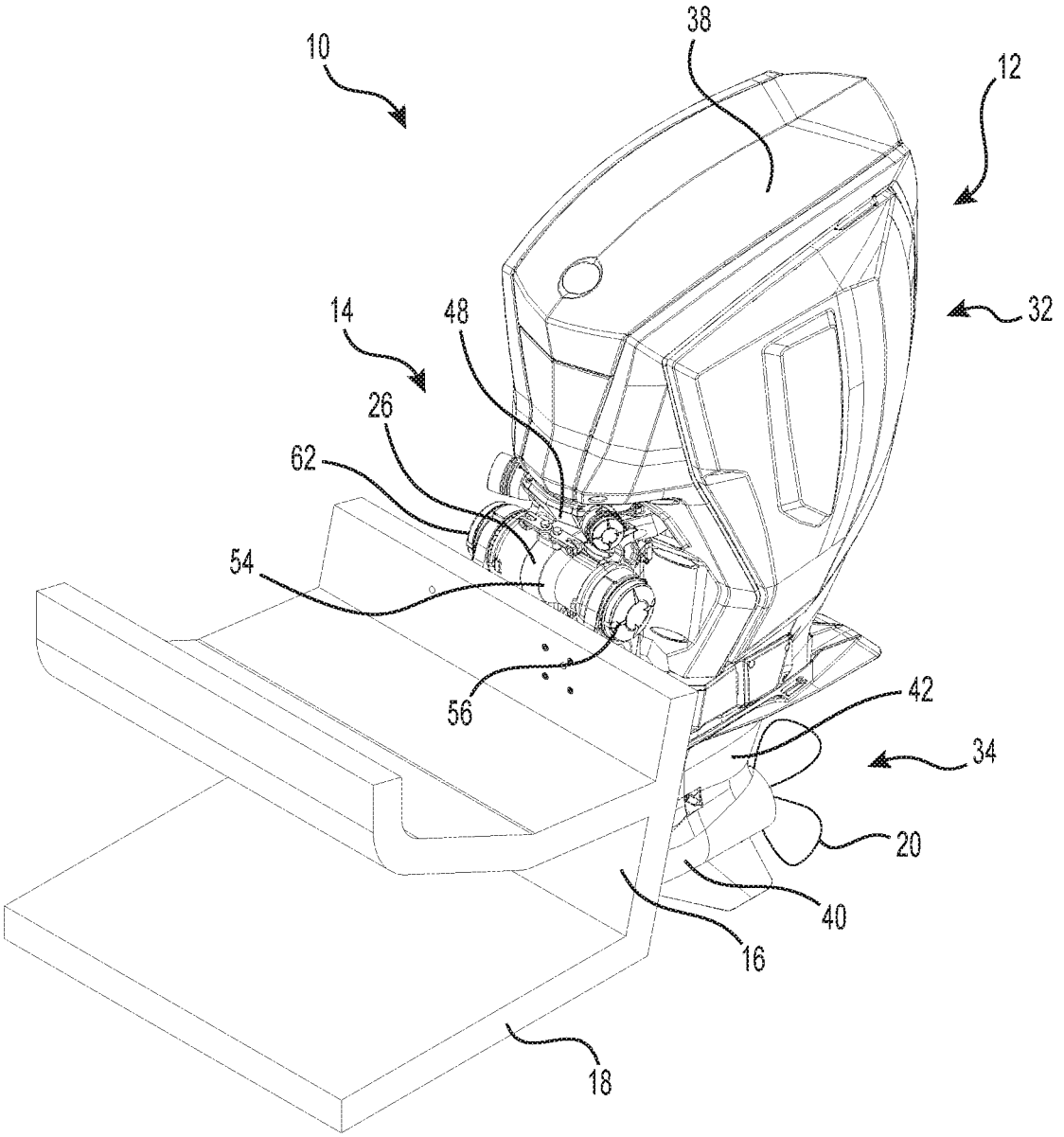
FIG. 1 is a perspective view taken from a front, left side of a marine outboard motor mounted in an upright position to a stern of watercraft.
Figure 2:
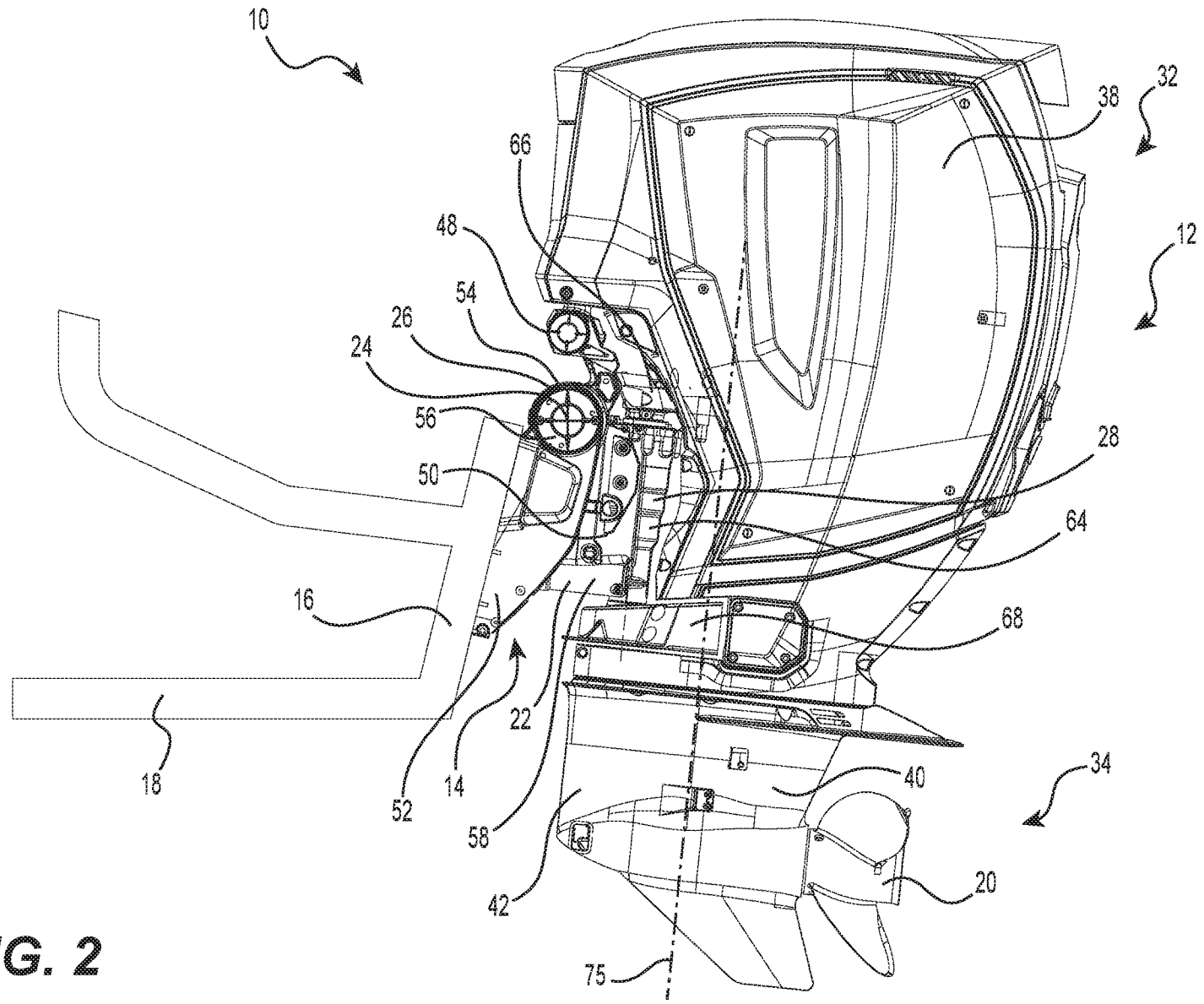
FIG. 2 is a left side elevation view of the outboard motor of FIG. 1 trimmed at a full trim in angle.

The present method and system will be described with respect to a marine outboard motor. However, it is contemplated that aspects of the present technology could be used with other marine motors, such as, for example, a stern drive which has a propulsion system mounted to a stern of a watercraft that is driven by an motor disposed inside the watercraft. Also, in an outboard motor, the drive unit is tilted and trimmed with the propulsion unit; as such drive unit tilting or trimming and propulsion unit tilting or trimming are used interchangeably herein. In the case of a stern drive for example, only the propulsion unit is tilted and trimmed, as such the indication of the drive unit being tilted or trimmed herein, when applied to a stern drive, should be understood as only the propulsion unit of the stern drive being tilted or trimmed.

With reference to FIGS. 1 to 5, a marine outboard motor 10, shown in the upright position, includes a drive unit 12 and a bracket assembly 14. The bracket assembly 14 supports the drive unit 12 on a stern 16 of a hull 18 of an associated watercraft (not shown). The drive unit 12 can be pivoted about a generally horizontal tilt/trim axis 24 relative to the hull 18 and the transom 16 between a full trim in position (see FIG. 2) and a tilted out position (see FIG. 5). This range of motion is divided into a range of trim angles that can be used to vary the attitude of the vessel when underway and a range of tilt angles that can be used to lift the drive unit 12 above the water line when docked or for trailering, for example. The boundaries of the range of trim angles (also referred to herein as the "trim range") are the full trim in position and a full trim out position (see FIG. 4). The boundaries of the range of tilt angles are the full trim out position and the tilted out position. The drive unit 12 is moved about the tilt/trim axis 24 by two linear actuators 22 (only one of which is shown) and by a rotary actuator 26 of the bracket assembly 14. More specifically, in this implementation, the drive unit 12 is trimmed in or out (i.e., moved within the range of trim angles) by the linear actuators 22 and is tilted in or out (i.e., moved within the tilt angle ranges) by the rotary actuator 26. It is contemplated that, in alternative implementations, the drive unit 12 is trimmed and tilted by a single actuator.

The drive unit 12 can also be steered left or right relative to the hull 18 by a steering rotary actuator 28 of the bracket assembly 14 about a steering axis 30. The steering axis 30 extends generally perpendicularly to the tilt/trim axis 24. When the drive unit 12 is in the upright position as shown in FIG. 1, the steering axis 30 extends generally vertically.

The actuators 22, 26 and 28 are hydraulic actuators. The actuators 22, 26 and 28 and their operation will be discussed in greater detail below. It is contemplated that the actuators 22, 26 and 28 could be other types of actuators of another type, such as for example, electrical actuators.

The drive unit 12 includes an upper portion 32 and a lower portion 34. The upper portion 32 includes a motor 36 (schematically shown in dotted lines in FIG. 3) surrounded and protected by a cowling 38. In this implementation, the motor 36 housed within the cowling 38 is an internal combustion engine, such as a two-stroke or four-stroke engine, having cylinders extending horizontally. It is contemplated that other types of engine could be used and that the cylinders could be oriented differently. Moreover, it is contemplated that the engine 36 could be another type of motor such as an electric motor or a diesel engine for example. The lower portion 34 includes a propulsion unit 40, also known as the gear case assembly, which includes a propeller 20, and a connection portion 42, which extends from the upper portion 32 to the gear case assembly 40.

Figure 3:
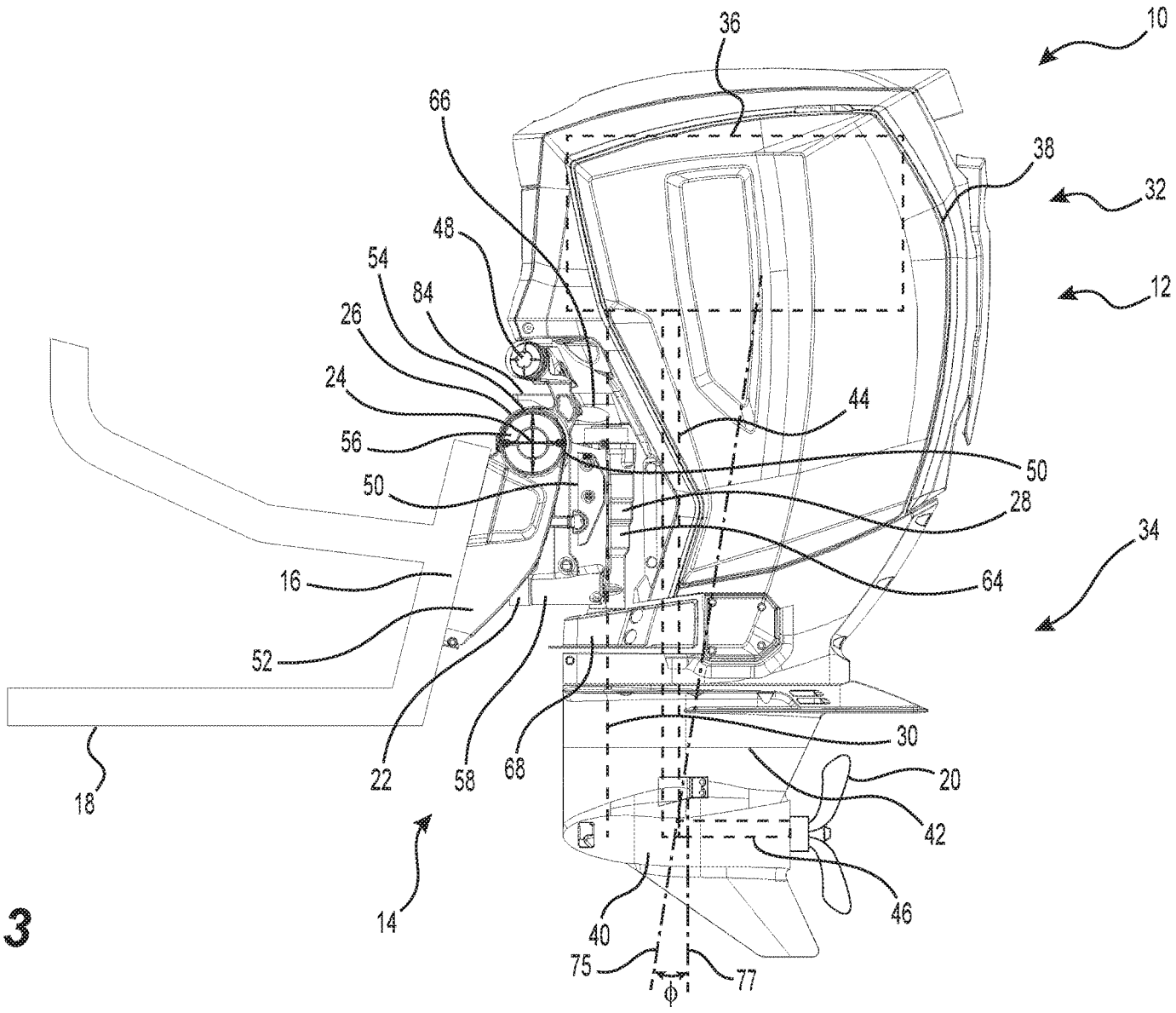
FIG. 3 is a left side elevation view of the outboard motor of FIG. 1 trimmed at an intermediate angle between the full trim in angle and a full trim out angle.

The engine 36 is coupled to a driveshaft 44 (schematically shown in dotted lines in FIG. 3). When the drive unit 12 is in the upright position as shown in FIG. 1, the driveshaft 44 is oriented vertically. It is contemplated that the driveshaft 44 could be oriented differently relative to the engine 36. The driveshaft 44 is coupled to a transmission (not shown) which is coupled to a propeller shaft 46 (FIG. 3) on which the propeller 20 is mounted. In the present implementation, the propeller shaft 46 is perpendicular to the driveshaft 44; however it is contemplated that it could be at other angles. The driveshaft 44, the transmission and the propeller shaft 46 transfer the power of the engine 36 to the propeller 20 disposed at the rear of the propulsion unit 40 of the drive unit 12. It is contemplated that the propulsion unit of the outboard motor 10 could alternatively include a jet propulsion device, turbine or other known propelling device.

To facilitate the installation of the outboard motor 10 on the watercraft, the outboard motor 10 is provided with a box 48. The box 48 is connected above the rotary actuator 26 and pivots about the tilt/trim axis 24 when the outboard motor 10 is tilted, but does not pivot about the steering axis 30 when the outboard motor 10 is steered. It is contemplated that the box 48 could be mounted elsewhere on the bracket assembly 14 or on the drive unit 12. Devices located inside the cowling 38 which need to be connected to other devices disposed externally of the outboard motor 10, such as on the deck or hull 18 of the watercraft, are provided with lines which extend inside the box 48. In one implementation, these lines are installed in and routed to the box 48 by the manufacturer of the outboard motor 10 during manufacturing of the outboard motor 10. Similarly, the corresponding devices disposed externally of the outboard motor 10 are also provided with lines that extend inside the box 48 where they are connected with their corresponding lines from the outboard motor 10. It is contemplated that one or more lines could be connected between one or more devices located inside the cowling 38 to one or more devices located externally of the outboard motor 10 and simply pass through the box 48. In such an implementation, the box 48 would reduce movement of the one or more lines when the outboard motor 10 is steered, tilted or trimmed.

Other known components of an engine assembly are included within the cowling 38, such as a starter motor, an alternator and the exhaust system. As it is believed that these components would be readily recognized by one of ordinary skill in the art, further explanation and description of these components will not be provided herein.

The bracket assembly 14 will now be described in more detail. The bracket assembly 14 includes a swivel bracket 50 pivotally connected to a stern bracket 52 via the rotary actuator 26. The stern bracket 52 includes a plurality of holes and slots (not shown) adapted to receive fasteners (not shown) used to fasten the bracket assembly 14 to the stern 16 of the watercraft. By providing many holes and slots, the vertical position of the stern bracket 50, and therefore the bracket assembly 14, relative to the stern 16 can be adjusted.

The rotary actuator 26 includes a cylindrical main body 54, a central shaft (not shown) disposed inside the main body 54 and protruding from the ends thereof, and a piston (not shown) surrounding the central shaft and disposed inside the main body 54. The main body 54 is located at an upper end of the swivel bracket 50 and is integrally formed therewith. It is contemplated that the main body 54 could be fastened, welded, or otherwise connected to the swivel bracket 50. The central shaft is coaxial with the tilt/trim axis 24. Splined disks (not shown) are provided over the portions of the central shaft that protrude from the main body 54. The splined disks are connected to the central shaft so as to be rotationally fixed relative to the central shaft. The stern bracket 52 has splined openings at the upper end thereof that receive the splined disks therein. As a result, the stern bracket 52, the splined disks and the central shaft are all rotationally fixed relative to each other. Anchoring end portions 56 are fastened to the sides of the stern bracket 52 over the splined openings thereof and the ends of the central shaft, thus preventing lateral displacement of the swivel bracket 50 relative to the stern bracket 52.

The piston is engaged to the central shaft via oblique spline teeth on the central shaft and matching splines on the inside diameter of the piston. The piston is slidably engaged to the inside wall of the cylindrical main body 54 via longitudinal splined teeth on the outer diameter of the piston and matching splines on the inside diameter of the main body 54. By applying pressure on the piston, by supplying hydraulic fluid inside the main body 54 on one side of the piston, the piston slides along the central shaft. Since the central shaft is rotationally fixed relative to the stern bracket 52, the oblique spline teeth cause the piston, and therefore the main body 54 (due to the longitudinal spline teeth), to pivot about the central shaft and the tilt/trim axis 24. The connection between the main body 54 and the swivel bracket 50 causes the swivel bracket 50 to pivot about the tilt/trim axis 24 together with the main body 54. Supplying hydraulic fluid to one side of the piston causes the swivel bracket 50 to pivot away from the stern bracket 52 (i.e. tilt out). Supplying hydraulic fluid to the other side of the piston causes the swivel bracket 50 to pivot toward the stern bracket 52 (i.e. tilt in). U.S. Pat. No. 7,736,206 B1, issued Jun. 15, 2010, the entirety of which is incorporated herein by reference, provides additional details regarding rotary actuators similar in construction to the rotary actuator 26. It is contemplated that the rotary actuator 26 could be replaced by one or more linear actuators.

To mechanically block the swivel bracket 50 in the tilted out position (shown in FIG. 5), which is the position that the swivel bracket 50 is typically kept at when the watercraft is in storage or on a trailer, the bracket assembly 14 is provided with a locking arm (not shown) pivotally connected to the swivel bracket 50. To use the locking arm, the swivel bracket 50 is pivoted upwards to the tilted out position and the locking arm is pivoted to its locking position where it makes contact with the stern bracket 52. The locking arm thus alleviates stress on the rotary actuator 26 and its associated hydraulic components during storage or transport on a trailer.

The linear actuators 22 each include a cylinder 58, a piston (not shown) disposed inside the cylinder 58, and a rod 60 connected to the piston and protruding from the cylinder 58. As can be seen, the cylinders 58 are located at a lower end of the swivel bracket 50. The cylinders 58 are integrally formed with the swivel bracket 50 and the lines which supply them with hydraulic fluid are formed thereby. It is contemplated that the cylinders 58 could alternatively be fastened, welded, or otherwise connected to the swivel bracket 50. The rods 60 extend generally perpendicularly to the tilt/trim axis 24 and to the steering axis 30. It is contemplated that the hydraulic linear actuators 22 could be replaced by other types of linear actuators having a fixed portion connected to the swivel bracket 50 and a movable portion being extendable and retractable linearly relative to the fixed portion. A shaft (not shown) with rollers 62 (FIG. 5) thereon extends from the rod 60 of the left actuator 22 to the rod 60 of the right actuator 22. The rollers 62 are made of stainless steel, but other materials, such as plastics, are contemplated.

By supplying hydraulic fluid inside the cylinders 58 on the side of the pistons opposite the side from which the rods 60 extend, the pistons slide inside the cylinders 58. This causes the rods 60 to extend further from the cylinders 58 and the rollers 62 to roll along and push against curved surfaces formed by ramps (not shown) connected to the stern bracket 52. The ramps are fastened to the back of the stern bracket 52. It is contemplated that the ramps could be welded to the stern bracket 52, integrally formed with the stern bracket 52, or otherwise connected to the stern bracket 52. As the rods 60 extend from their respective cylinders 58, the rollers roll down along the curved surfaces of the ramps. As the rollers roll down along the curved surfaces of the ramps, they move away from the stern bracket 52 due to the profile of the surfaces of the ramps. As a result of the rods 60 extending from the cylinders 58 and the rollers 62 rolling along the surfaces the ramps, the swivel bracket 50 pivots away from the stern bracket 52 (i.e. trims out) about the tilt/trim axis 24 up to the angle shown in FIG. 4 where the rods 60 are fully extended.

Figure 4:
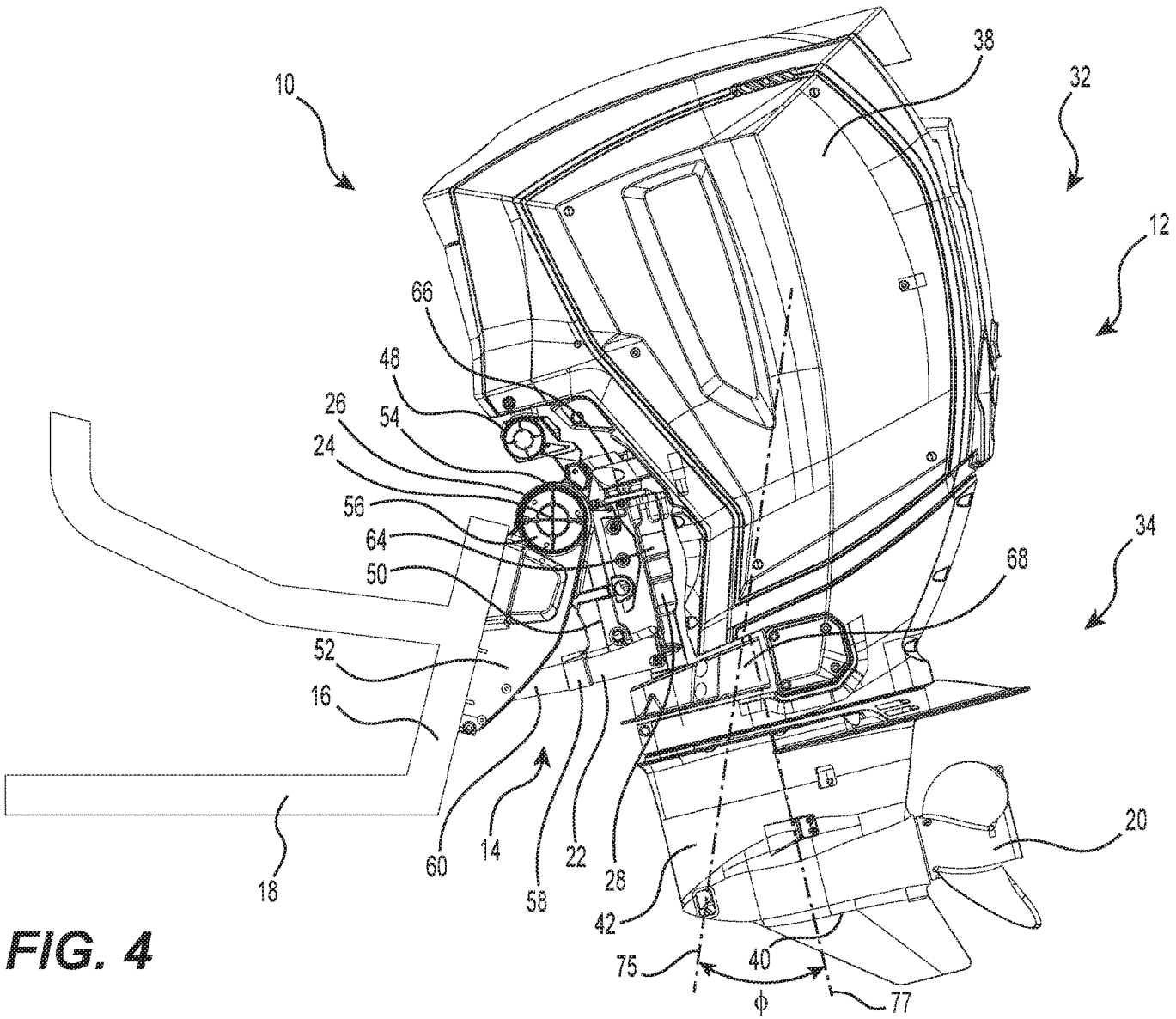
FIG. 4 is a left side elevation view of the outboard motor of FIG. 1 trimmed at the full trim out angle.
Figure 5:
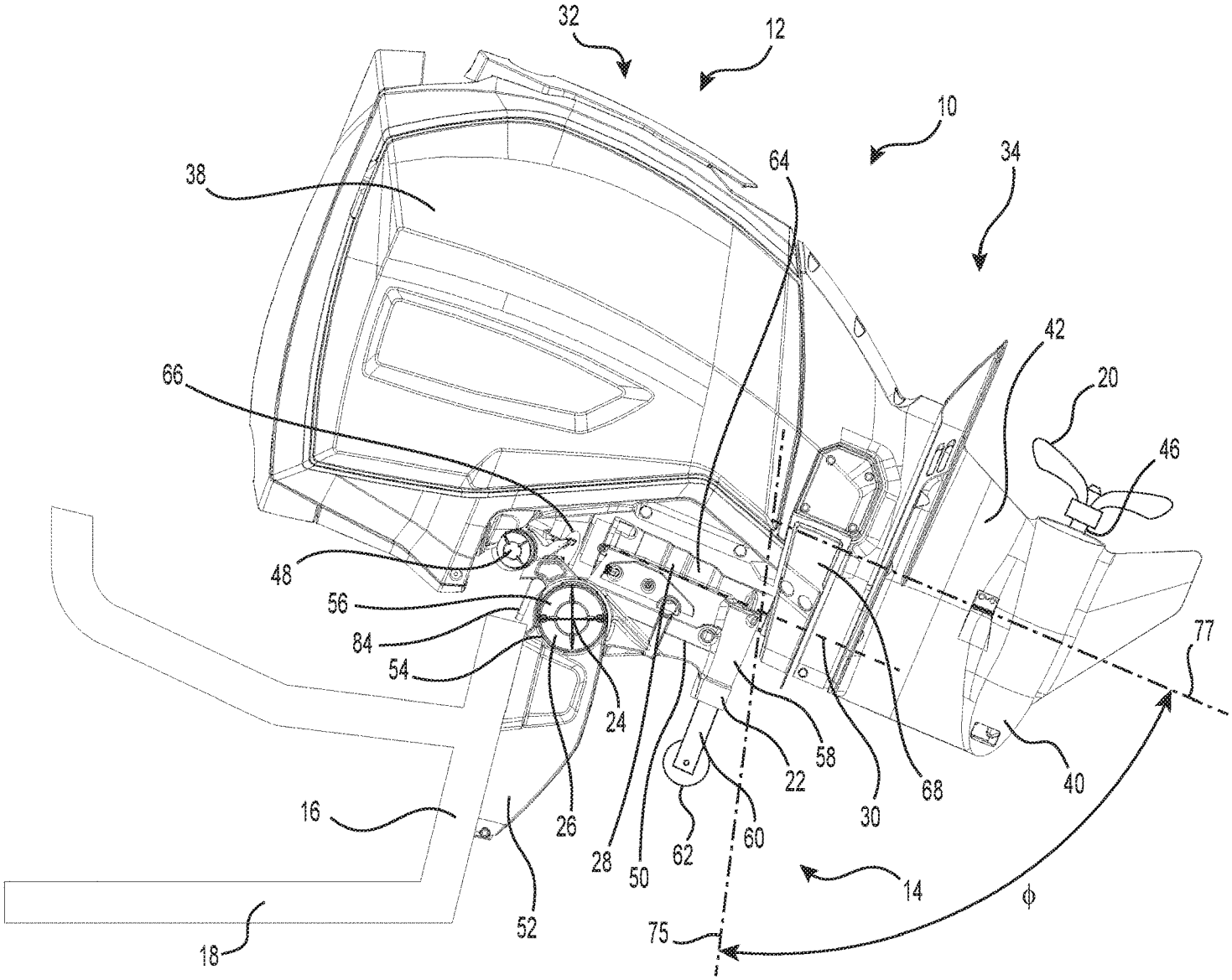
FIG. 5 is a left side elevation view of the outboard motor of FIG. 1 in a tilted out position.

In one exemplary implementation, the swivel bracket 50 pivots by an angle of 20 degrees from its full trim in position (i.e. the position shown in FIG. 2) to its full trim out position shown in FIG. 4. It is contemplated that this angle could be between 15 and 30 degrees. Once this angle is reached, the rods have reached the limit of their travel and should further pivoting of the swivel bracket 50 relative to the stern bracket 52 (i.e. tilt) be desired, the rotary actuator 26 provides the pivoting motion up to the angle shown in FIG. 5. As can be seen in FIG. 5, the rollers 62 no longer make contact with the stern bracket 52. To pivot the swivel bracket 50 back toward the stern bracket 52 (i.e. trim in) about the tilt/trim axis 24 from the position shown in FIG. 4, the hydraulic fluid can be actively removed from the cylinders 58 (i.e. pumped out), or can be pushed out of the cylinders 58 by the pistons due to the weight of the swivel bracket 50 and the drive unit 12 pushing toward the stern bracket 52. The movement achieved by the linear actuators 22 is known as trim as they allow for precise angular adjustment of the swivel bracket 50 relative to the stern bracket 52, and therefore of the propulsion unit 40, at a slower angular speed than that provided by the rotary actuator 26. It is however contemplated that the linear actuators 22 could be omitted such that the rotary actuator 26 is solely responsible for the trim and tilt movements of the swivel bracket 50.

Similarly to the rotary actuator 26, the steering rotary actuator 28 includes a cylindrical main body 64, a central shaft (not shown) disposed inside the main body 64 and protruding from the ends thereof and a piston (not shown) surrounding the central shaft and disposed inside the main body 64. The main body 64 is centrally located along the swivel bracket 50 and is integrally formed therewith. It is contemplated that the main body 64 could be fastened, welded, or otherwise connected to the swivel bracket 50. The central shaft is coaxial with the steering axis 30. Splined disks (not shown) are provided over the portions of the central shaft that protrude from the main body 64. The splined disks are connected to the central shaft so as to be rotationally fixed relative to the central shaft. An upper generally U-shaped drive unit mounting bracket 66 has a splined opening therein that receives the upper splined disk therein. Similarly, a lower generally U-shaped drive unit mounting bracket 68 has a splined opening therein that receives the lower splined disk therein. The upper and lower drive unit mounting brackets 66, 68 are fastened to the drive unit 12 so as to support the drive unit 12 onto the bracket assembly 14. As a result, the drive unit 12, the splined disks and the central shaft are all rotationally fixed relative to each other. Anchoring end portions (not shown) are fastened to the upper and lower drive unit mounting brackets 66, 68 over the splined openings thereof and the ends of the central shaft, thus preventing displacement of the drive unit 12 axially along the steering axis 30.

The piston is engaged to the central shaft via oblique spline teeth on the central shaft and matching splines on the inside diameter of the piston. The piston is slidably engaged to the inside wall of the cylindrical main body 64 via longitudinal splined teeth on the outer diameter of the piston and matching splines on the inside diameter of the main body 64. By supplying hydraulic fluid inside the main body 64 on one side of the piston, the piston slides along the central shaft. Since the main body 64 is rotationally fixed relative to the swivel bracket 50, the oblique spline teeth cause the central shaft and therefore the upper and lower drive unit mounting brackets 66, 68, to pivot about the steering axis 30. The connections between the drive unit 12 and the upper and lower drive unit mounting brackets 66, 68 cause the drive unit 12 to pivot about the steering axis 30 together with the central shaft. Supplying hydraulic fluid to one side of the piston causes the drive unit 12 to steer left. Supplying hydraulic fluid to the other side of the piston causes the drive unit 12 to steer right. U.S. Pat. No. 7,736,206 B1, issued Jun. 15, 2010, provides additional details regarding rotary actuators similar in construction to the rotary actuator 28. It is contemplated that the rotary actuator 28 could be replaced by one or more linear actuators.

To supply hydraulic fluid to the rotary actuators 26, 28 and the linear actuators 22, the bracket assembly 14 is provided with pumps 70, 72 (FIG. 6) each connected to a plurality of valves (not shown) and a hydraulic fluid reservoir (not shown). It is contemplated that there could be more than one pump 70 and more than one pump 72. The pumps 70, 72 are mounted to the swivel bracket 50 so as to pivot together with the swivel bracket 50 about the trim-tilt axis 24. It is contemplated that in some alternative implementations of the present bracket assembly 14, that the pumps 70, 72 could be mounted to the stern bracket 52 or inside the watercraft instead.

The pumps 70, 72 are bi-directional electric pumps, meaning that the direction of the flow of hydraulic fluid from each pump 70, 72 can be changed by changing the direction of rotation of their respective motors. It is contemplated that the pumps 70, 72 could be unidirectional pumps, in which case it is contemplated that a system of valves could be used to vary the direction of the flow or that the pumps 70, 72 could cause flow of hydraulic fluid in one direction and that additional pumps could cause flow of hydraulic fluid in the other direction. It is also contemplated that other types of pumps could be used, such as, for example, axial flow pumps or reciprocating pumps.

The pump 70 supplies hydraulic fluid to the trim actuators 22 and to the tilt actuator 26 to cause trim and tilt of the drive unit 12. It should be noted that, as the swivel bracket 50 is being trimmed out or in by the linear actuators 22, fluid is being simultaneously supplied to the rotary actuator 26 to obtain the same amount of angular movement in the same direction and at the same rate. The pump 72 supplies hydraulic fluid to the steering actuator 28 to cause steering of the drive unit 12.

Figure 6:
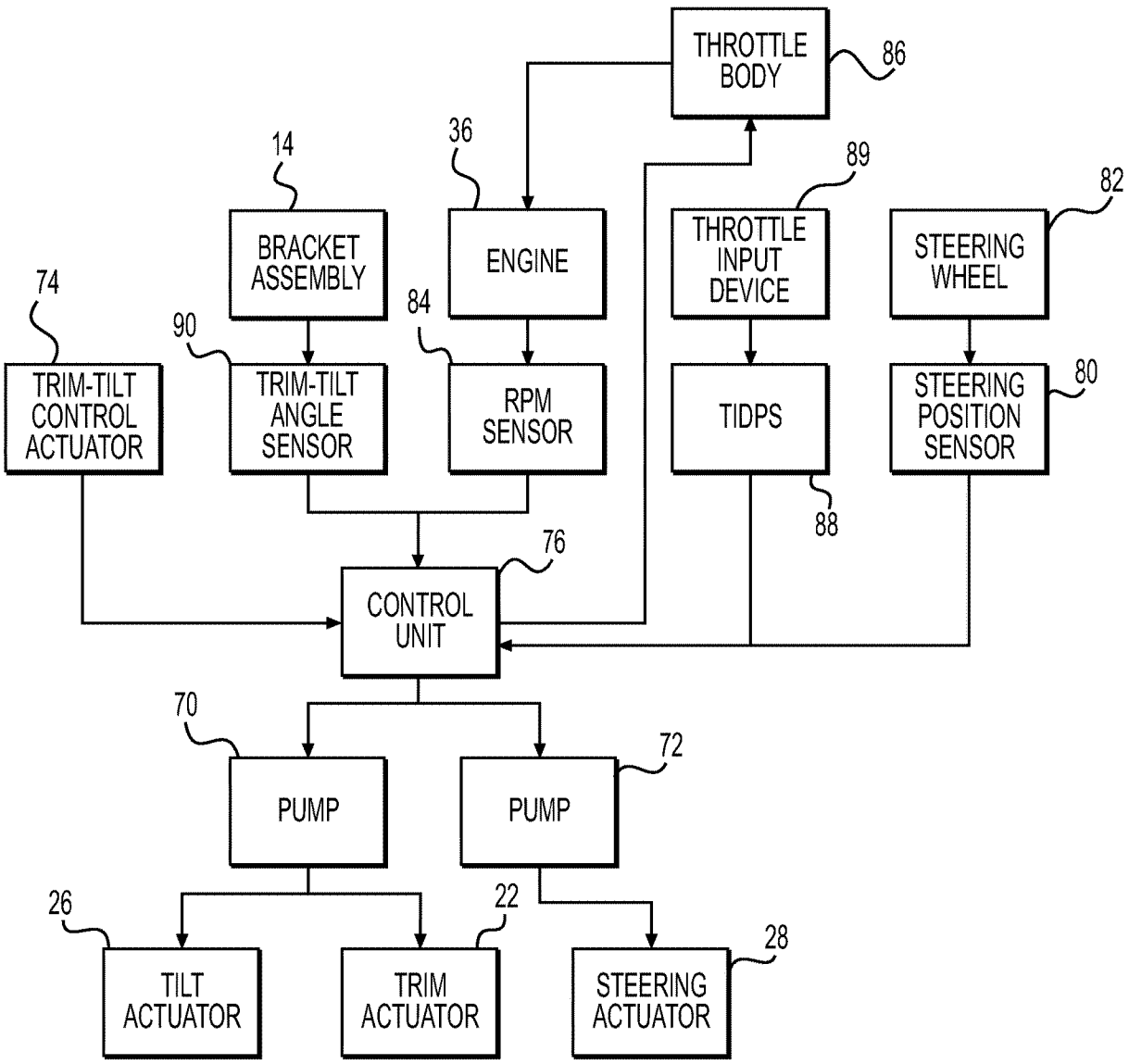
FIG. 6 is a schematic representations of various components of the outboard motor of FIG. 1.

The pump 70 is actuated in response to the actuation by the driver of the watercraft of a trim-tilt control actuator 74, which in the present implementation is a tilt/trim out/in switch (FIG. 6). Actuation of the switch 74 sends a signal to a control unit 76 of the outboard motor 10 that then sends an appropriate signal to the pump 70. The control unit 76 is disposed inside the cowling 38, but it is contemplated that it could be located elsewhere. Actuation of the switch 74 to one position causes the pump 70 to supply hydraulic fluid to the trim actuators 22 and the tilt actuator 26 to cause the actuators 22, 26 to pivot the drive unit 12 away from the stern 16 of the watercraft (i.e. out). Actuation of the switch 74 to another position causes the pump 70 to supply hydraulic fluid to the trim actuators 22 and the tilt actuator 26 to cause the actuators 22, 26 to pivot the drive unit 12 toward the stern 16 of the watercraft (i.e. in). It is contemplated that the switch 74 could be replaced by separate switches or buttons for the in and out movement and/or for separating the trim and tilt movements (i.e. a trim controller and a tilt controller). It is also contemplated that the switch 74 could be replaced by, but not limited to, one or more levers or icons on a touchscreen. As will be explained in greater detail below, the pump 70 can also be controlled automatically by the control unit 76 to automatically adjust a trim/tilt of the drive unit 12.

The pump 72 is actuated in response to signals received by the control unit 76 from a steering position sensor 80 (FIG. 6). The steering position sensor 80 reads a position of the steering wheel 82 (FIG. 6) of the watercraft and sends a corresponding signal to the control unit 76. The control unit 76 then sends an appropriate signal to the pump 72 to actuate the steering actuator 28 in order to steer the drive unit 12 in the proper direction. It is contemplated that the pump 72 and the steering position sensor 80 could be omitted on vessels with a hydraulic steering system that use a hydraulic helm to connect the steering wheel 82 directly hydraulically to the steering actuator 28. It is contemplated the steering position sensor 80 could be omitted on vessels with a hydraulic power steering system that uses a pump 72 to reduce the steering effort required by the operator steering the vessel with a hydraulic helm. It is also contemplated that the pump 72, the steering position sensor 80, and the steering actuator 28 could be omitted in which case the steering wheel 82 could be mechanically connected to the drive unit 12, by cables for example, to mechanically steer the drive unit 12, or the steering wheel 82 could be replaced by a tiller.

Additional components of the outboard motor 10 will now be described with reference to FIG. 6.

As can be seen, a motor speed sensor (RPM sensor) 84 is connected to the engine 36. The motor speed sensor 84 senses a speed of rotation of a crankshaft (not shown) of the engine 36 and sends a signal corresponding to this speed to the control unit 76. It is contemplated that the motor speed sensor 84 could alternatively sense a speed of rotation of a flywheel, a counterbalance shaft, or a camshaft (all not shown) of the engine 36 or of the driveshaft 44 or the propeller shaft 46 which either corresponds to the speed of rotation of the engine 36 or can be converted to the speed of rotation of the engine 36.

As can also be seen in FIG. 6, the engine 36 is connected to a throttle body 86. More specifically, the throttle body 86 is connected to an air inlet (not shown) of the engine 36. The throttle body 86 contains a throttle valve (not shown), the position of which controls the amount of air supplied to the engine 36 for combustion. It is contemplated that the engine 36 could be provided with more than one throttle body 86. In an implementation where the engine 36 is a carbureted engine, the throttle body 86 is in the form of a carburetor which is a type of throttle body through which fuel is also supplied to the engine 36. In the present implementation, the position of the throttle valve in the throttle body 84 is controlled by the control unit 76. The control unit 76 receives an input signal from a throttle input device position sensor (TIDPS) 88. The throttle input device position sensor 88 senses a position of a throttle input device 89 (e.g., a throttle lever or pedal) disposed in the watercraft and which is actuated by the driver of the watercraft. The throttle input device 89 can be actuated through a range of throttle request positions from 0 percent throttle request to 100 percent throttle request. When in operation and the throttle input device 89 is in the 0 percent throttle request position and the throttle valve of the throttle body 86 is in this requested position, the engine 36 is idling. When in operation and the throttle lever is in the 100 percent throttle request position and the throttle valve of the throttle body 86 is in this requested position, the engine 36 is at "wide open throttle". Watercraft equipped with an outboard motor 10 that can be operated in forward, neutral and reverse can be provided with two distinct levers: one for controlling throttle request and one for switching between forward, neutral and reverse modes of operation. Watercraft can also be provided with a single throttle lever that controls both throttle request and forward/neutral/reverse. In such single-lever implementations, the throttle lever can be moved forward from a central neutral position to enter the forward mode of operation, and rearward from the central neutral position to enter the reverse mode of operation. Based on the signal received from the TIDPS 88 and other signals received from other sensors of the outboard engine 10, such as the engine speed sensor 84, the control unit 76 determines the position that the throttle valve of the throttle body 86 should have and sends a signal to a motor connected to the throttle valve to move the throttle valve to this position. In an alternative implementation, it is contemplated that the throttle input device 89 could be mechanically linked to the throttle valve of the throttle body 86 such that movement of the throttle input device 89 moves the throttle valve via a mechanical connection. A throttle valve position sensor (not shown) senses a position of the throttle valve of the throttle body 86 and sends a signal representative of this position to the control unit 76. The control unit 76 uses this signal from the throttle valve position sensor to determine if the throttle valve is in the desired position.

As can also be seen in FIG. 6, a trim-tilt angle sensor 90 is connected to the bracket assembly 14. The trim-tilt angle sensor 90 has one portion disposed on the swivel bracket 50 and another portion disposed on the stern bracket 52 thereby allowing the trim-tilt angle sensor 90 to sense the angle between the brackets 50 and 52, which is indicative of a trim-tilt angle $\phi$ of the propulsion unit 40. The trim-tilt angle sensor 90 sends a signal indicative of the sensed trim-tilt angle $\phi$ to the control unit 76. The control unit 76 uses this signal from the trim angle sensor 90 to determine if the propulsion unit 40 is at the desired trim-tilt angle, if the propulsion unit 40 has been trimmed in the desired direction, and if the propulsion unit 40 has reached the full trim in angle, the full trim out angle or the full tilt out angle. It is contemplated that the trim-tilt angle sensor 90 could be a different type of sensor. For example, the trim-tilt angle sensor 90 could sense the amount by which at least one of the rods 60 of the trim actuators 22 has extended from it corresponding cylinder 58, which can then be converted to a trim-tilt angle by the control unit 76.

When the propulsion unit 40 is in the full trim in position (FIG. 2), the trim-tilt angle $\phi$ is 0° as the drive unit 12 generally extends along a full trim in reference axis 75. In the full trim out position of the propulsion unit 40 (FIG. 4), the trim-tilt angle $\phi$ is approximately 20° which is referred to as the full trim out angle of the propulsion unit 40. That is, in the full trim out position of the propulsion unit 40, the drive unit 12 extends along an axis 77 that is rotated approximately 20° from the reference axis 75. As previously mentioned, it is contemplated that the full trim out angle could be between 15° and 25° inclusively. It is contemplated that the full trim out angle could have any other suitable value in other implementations. In the tilted out position of the propulsion unit 40 (FIG. 5), the trim-tilt angle $\phi$ is approximately 82°. It is contemplated that, in the tilted out position of the propulsion unit 40, the trim-tilt angle $\phi$ may be between 70° and 85°. The trim-tilt angle of the propulsion unit may have any other suitable angle at the tilted out position.

Although FIG. 6 illustrates a single control unit 76, it is contemplated that the functions of the control unit 76 could be separated between multiple control units. For example, it is contemplated that one control unit could be responsible for the functions associated with controlling the tilting, trimming, and steering of the drive unit 12, while another control unit could be responsible for controlling the operation of the engine 36.

Turning now to FIGS. 7 to 10, methods for controlling a trim-tilt angle of the propulsion unit 40 of the outboard motor 10 will be described below.

Figure 7:
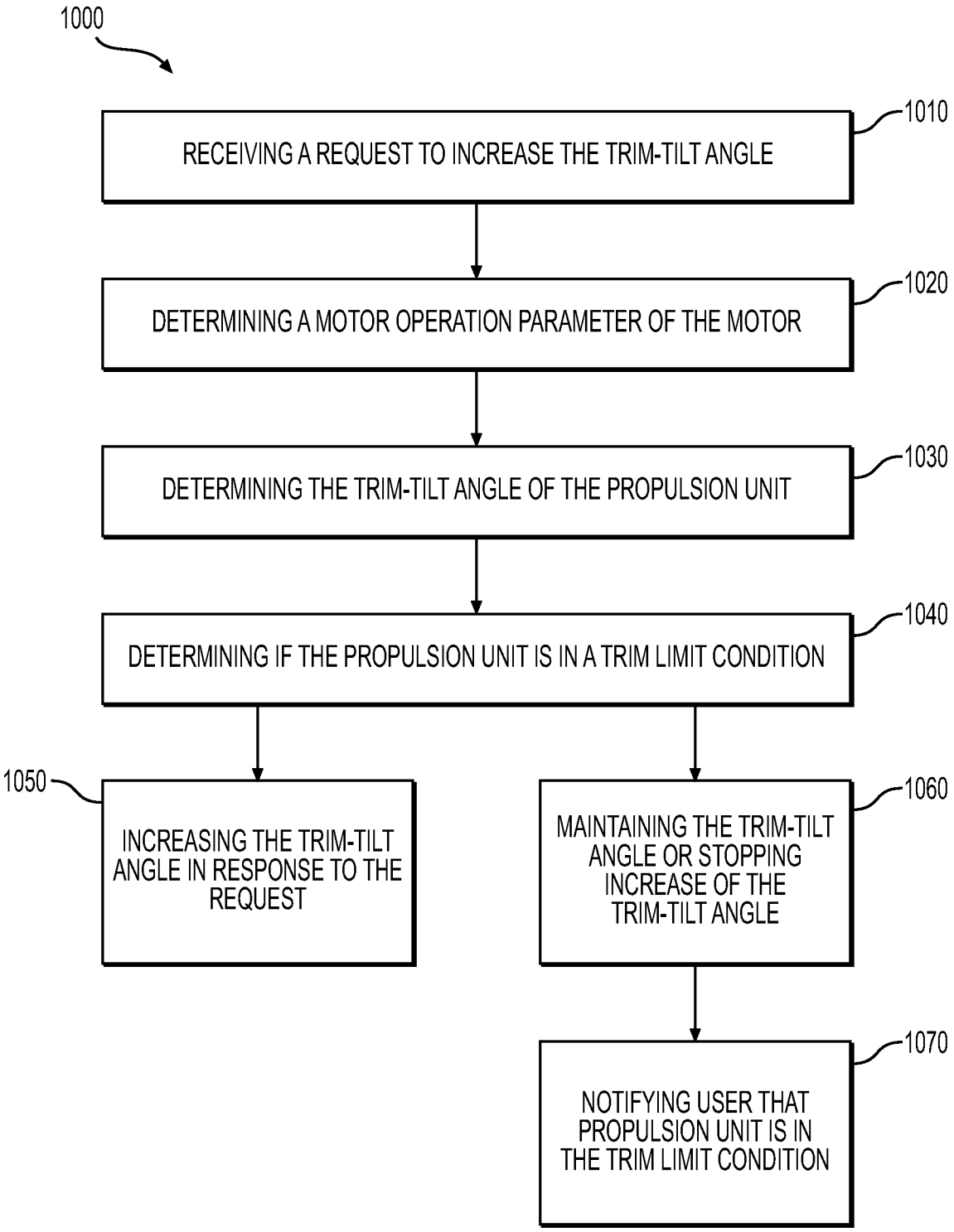
FIG. 7 is a flow diagram of a method for controlling the trim-tilt angle of the outboard motor of FIG. 1.

FIG. 7 illustrates a method 1000 in which the propulsion unit 40 is initially positioned such that the trim-tilt angle of the propulsion unit 40 is in the trim angle range. In other words, the trim-tilt angle of the propulsion unit 40 is between the full trim in angle and an angle generally referred to as a threshold trim out angle. At step 1010, the control unit 76 receives a request to increase the trim-tilt angle of the propulsion unit 40. In other words, the user engages the trim-tilt control actuator 74 to increase the trim-tilt angle of the propulsion unit 40. This causes a signal to be received by the control unit 76 from the trim-tilt control actuator 74 indicative of a desired increase of the trim-tilt angle.

Before the control unit 76 is able to fulfill the request to increase the trim-tilt angle, the control unit 76 is configured to first determine if the propulsion unit 40 is in a trim limit condition. To that end, at step 1020, the control unit 76 determines a motor operation parameter of the motor 36 and at step 1030, the control unit 76 determines the trim-tilt angle of the propulsion unit 40. The control unit 76 determines the trim-tilt angle of the propulsion unit 40 by sensing the trim-tilt angle of the propulsion unit 40 through a signal received from the trim-tilt sensor 90. Based on the determined motor operation parameter and trim-tilt angle, at step 1040, the control unit 76 determines if the propulsion unit 40 is in the trim limit condition. That is, the control unit 76 determines if the following two conditions are met: (i) the determined motor operation parameter is greater than a predetermined value of the motor operation parameter, and (ii) the trim-tilt angle is equal to or greater than a threshold trim out angle of the propulsion unit 40. If these two conditions are met, then the control unit 76 determines that the propulsion unit 40 is in the trim limit condition. Otherwise, the control unit 76 determines that the propulsion unit 40 is not in the trim limit condition.

In this implementation, the threshold trim out angle of the propulsion unit 40 is 96.5% of the trim range, although other threshold trim out angles are contemplated. For example, in some implementations, the threshold trim out angle of the propulsion unit 40 is the full trim out angle of the propulsion unit 40.

In this implementation, the predetermined value of the motor operation parameter corresponds to a throttle request of the motor 36 of approximately 40% (±2%). It is contemplated that the predetermined value of the motor operation parameter can correspond to a throttle request of the motor 36 between 30% and 50% inclusively.

More specifically, in this implementation, the motor operation parameter of the motor 36 is a position of the throttle input device 89 and the predetermined value of the motor operation parameter is a predetermined position of the throttle input device 89. Therefore, in order determine the motor operation parameter in this implementation, the control unit 76 senses the position of the throttle input device 89 through the throttle input device position sensor 88. Thus, in this implementation, the trim limit condition is characterized at least in part by the sensed position of the throttle input device 89 being equal to or greater than a predetermined position of the throttle input device 89. In other words, in order to determine that the propulsion unit 40 is in the trim limit condition, the control unit 76 determines if the sensed position of the throttle input device 89 is between the predetermined position of the throttle input device 89 and the full throttle position of the throttle input device 89. Thus, in this implementation, the predetermined position of the throttle input device 89 corresponds to a throttle request of the motor of approximately 40% (±2%). It is contemplated that the predetermined position of the throttle input device 89 can correspond to a throttle request of the motor 36 between 30% and 50% inclusively.

In other implementations, the motor operation parameter is the motor speed sensed from the motor speed sensor 84 rather than the position of the throttle input device 89. In such implementations, part of determining if the propulsion unit 40 is in the trim limit condition is to verify if the sensed motor speed (RPM) is greater than a predetermined motor speed. It is contemplated that the predetermined motor speed can be between 1500 and 3000 rpm inclusively.

The motor operation parameter may be any other suitable motor operation parameter in other implementations. For example, in some implementations, the motor operation parameter may be a position of the throttle in the throttle body 86 as sensed by the throttle position sensor.

In this description, the terms "throttle" and "throttle request" apply both to implementations where the motor 36 is an internal combustion engine and implementations where the motor 36 is an electric motor. Notably, while for electric motors there is no throttle to control the flow of fluid, the industry has nevertheless kept this nomenclature. In particular, in the context of electric motors, throttle request corresponds to a power request, and the throttle input device 89 is used to make this power request.

If at step 1040 the control unit 76 determines that the propulsion unit 40 is not in the trim limit condition, the method proceeds to step 1050, whereby the control unit 76 increases the trim-tilt angle of the propulsion unit 40 in response to the request to increase the trim-tilt angle.

However, if at step 1040 the control unit 76 determines that the propulsion unit 40 is in the trim limit condition, the method proceeds to step 1060, whereby the control unit 76 either maintains the trim-tilt angle at its current position or stops the increase of the trim-tilt angle. In either case, the trim up function is deactivated as the control unit 76 prevents the trim-tilt angle from increasing. This may, inter alia, prevent the outboard motor 10 from moving to a position about the trim-tilt axis 24 where there is a risk of ventilating the propeller 20.

From step 1060, at step 1070, the control unit 76 notifies a user of the engine 36 when the propulsion unit 40 is determined to be in the trim limit condition. More specifically, in this implementation, the control unit 76 causes a user interface of the watercraft 10 to display a notification alerting the user to the trim limit condition of the propulsion unit 40. For example, the notification may be a symbol, a word, a color or other graphic element displayed on a screen (not shown) of the user interface. The notification may also consist of a lighting element (e.g., a bulb) of the user interface illuminating. Alternatively or additionally, the notification can be a sound played over a speaker (not shown) of the user interface. It is noted that step 1070 is optional.

Figure 8A:
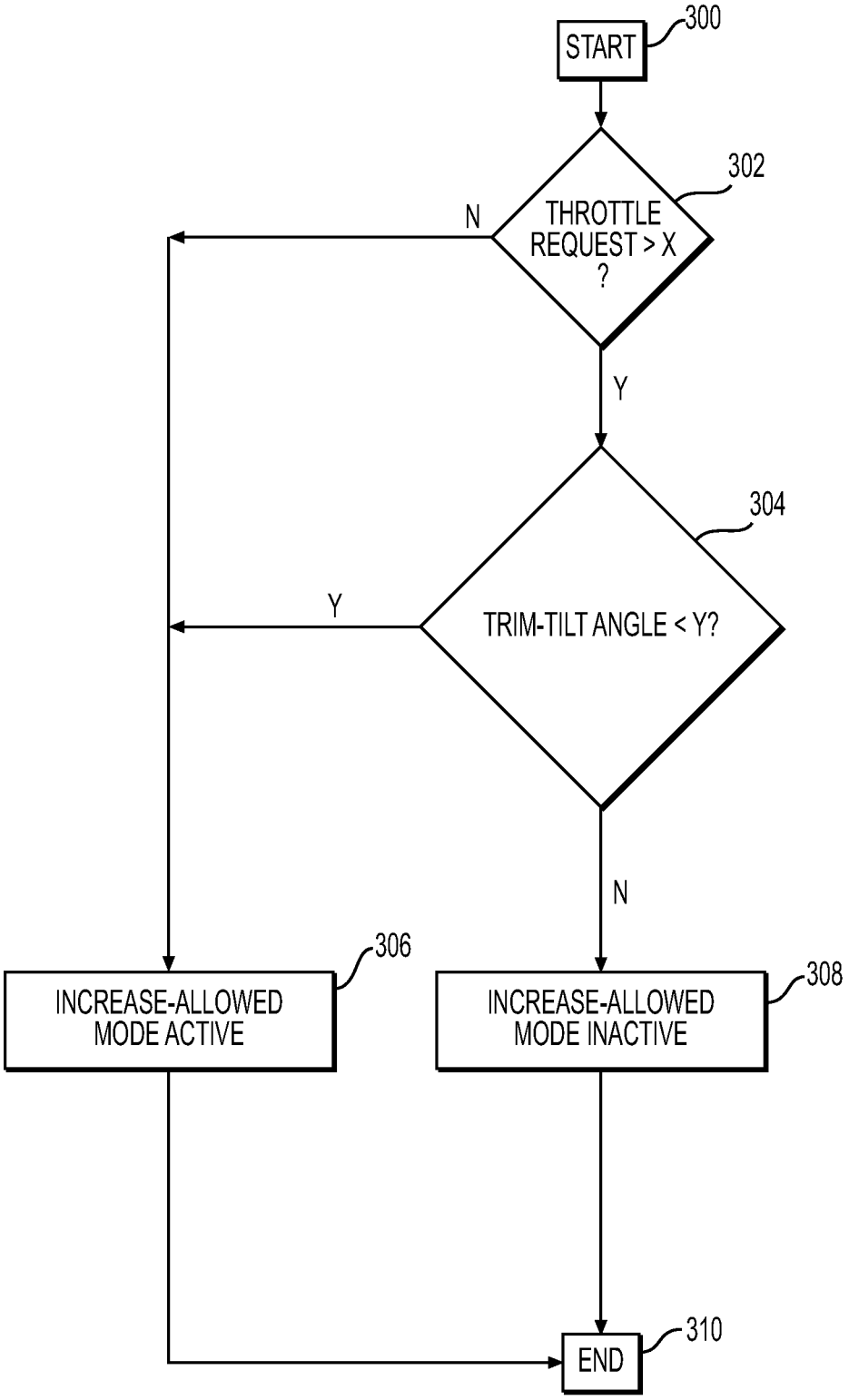
FIG. 8A is a logic diagram of an example of a detailed implementation of the method of FIG. 7.

FIG. 8A illustrates an example of a detailed implementation of the method of FIG. 7. The method illustrated in FIG. 8A starts at step 300. At step 302, the control unit 76 determines if the throttle request corresponding to the position of the throttle input device 89 as sensed by the TIDPS 88 is greater than "X", a predetermined throttle request. In this implementation, the predetermined throttle request is approximately 40%. It is contemplated that the predetermined throttle request may be between 30% and 50% inclusively. If at step 302, the control unit 76 determines that the throttle request is not greater than the predetermined throttle request, then the method proceeds to step 306 where an "increase-allowed mode" is activated. When the increase-allowed mode of the control unit 76 is active, the control unit 76 can control the pump 70 to cause the actuator 26 and/or the actuator 22 to cause an increase of the trim-tilt angle of the propulsion unit 40 (i.e., an increase of the trim-tilt angle is allowed by the control unit 76). Conversely, when the increase-allowed mode of the control unit 76 is inactive, the control unit 76 cannot control the pump 70 to cause the actuator 26 and/or the actuator 22 to cause an increase of the trim-tilt angle of the propulsion unit 40 (i.e., an increase of the trim-tilt angle is denied by the control unit 76). After activating the increase-allowed mode of the control unit 76, the method proceeds to step 310 where the method ends and restarts again at step 300. If at step 302, the control unit 76 determines that the throttle request is greater than the predetermined throttle request, the method proceeds to step 304. At step 304, the control unit 76 determines if the trim-tilt angle of the propulsion unit 40 is less than "Y", a threshold trim out angle which, in this implementation, is 96.5% of the trim range. The threshold trim out angle may have any other suitable value in other implementations (e.g., the full trim out angle). If the trim-tilt angle is determined to be less than the threshold trim out angle, the method proceeds to step 306, where the increase-allowed mode of the control unit 76 is activated as described above, and then to step 310 where the method ends and restarts again at step 300. On the other hand, if the trim-tilt angle is determined not to be less than the threshold trim out angle (i.e., the trim-tilt angle is equal to or greater than the threshold trim out angle), the method process to step 308 where an "increase-allowed mode" is deactivated. As mentioned above, when the increase-allowed mode of the control unit 76 is inactive, the control unit 76 does not control the pump 70 to cause the actuator 26 and/or the actuator 22 to cause an increase of the trim-tilt angle of the propulsion unit 40 (i.e., an increase of the trim-tilt angle is denied by the control unit 76 because the propulsion unit 40 is in the trim limit condition). The method then proceeds to step 310 where the method ends and restarts again at step 300.

Figure 8B:
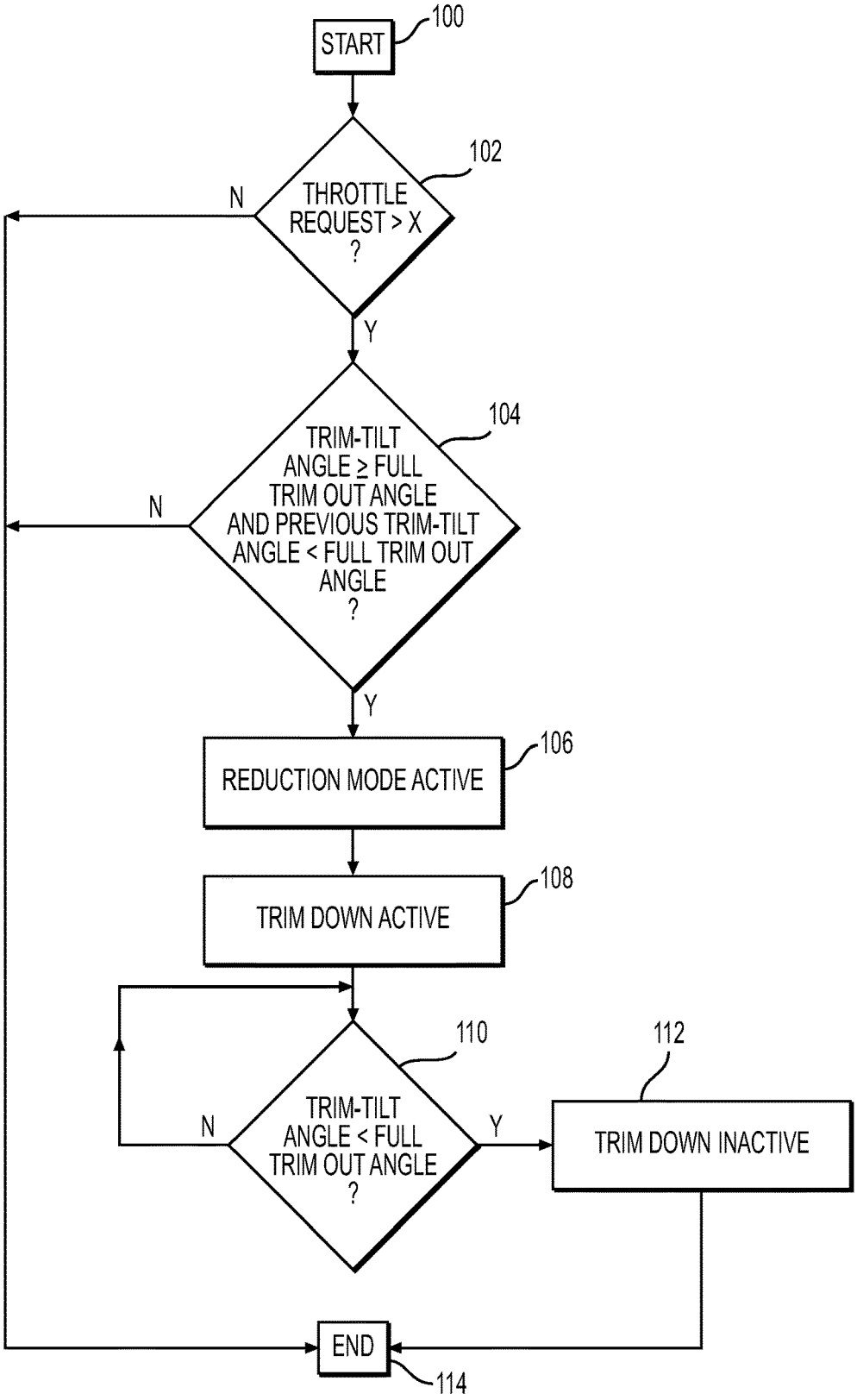
FIG. 8B is a logic diagram of another example of a detailed implementation of the method of FIG. 7.

FIG. 8B illustrates another example of a detailed implementation of the method of FIG. 7. The method illustrated in FIG. 8B starts at step 100. At step 102, the control unit 76 determines if the throttle request corresponding to the position of the throttle input device 89 as sensed by the TIDPS 88 is greater than "X", the predetermined throttle request. In this implementation, the predetermined throttle request is approximately 40%. It is contemplated that the predetermined throttle request may be between 30% and 50% inclusively. If at step 102, the control unit 76 determines that the throttle request is not greater than the predetermined throttle request, then the method proceeds to step 114 where the method ends and restarts again at step 100. If at step 102, the control unit 76 determines that the throttle request is greater than the predetermined throttle request, the method proceeds to step 104. At step 104, the control unit 76 determines if the trim-tilt angle of the propulsion unit 40 is greater than "Y", the threshold trim out angle which, in this implementation, is the full trim out angle. More specifically, the control unit 76 determines if (i) the trim-tilt angle is equal to or greater than the full trim out angle of the propulsion unit 40, and (ii) the previously recorded value of the trim-tilt angle (which is stored in a memory of the control unit 76) is smaller than the full trim out angle. The threshold trim out angle may have any other suitable value in other implementations (e.g., 96.5% of the trim range). If one or both of the conditions is not met, the method proceeds to step 114 where the method ends and restarts again at step 100. However, if both conditions are met, the method proceeds to step 106 where a "reduction mode" is activated. The reduction mode of the control unit 76 is configured to reduce the trim-tilt angle of the propulsion unit 40 to a value lower than the full trim out angle without user input. The method thus proceeds to step 108 where a trim down procedure of the propulsion unit 40 is activated (i.e., the trim-tilt angle is reduced). In particular, the control unit 76 sends a signal to the pump 70 to cause the actuator 26 and/or the actuator 22 to reduce the trim-tilt angle of the propulsion unit 40. Next, the method proceeds to step 110 where the control unit 76 determines if the trim-tilt angle is smaller than the full trim out angle of the propulsion unit 40. If this condition is met, the method proceeds to step 112 where the trim down mode procedure is deactivated. However, if the condition is not met, then the method returns to step 110 and the trim-tilt angle continues being reduced until the trim-tilt angle is determined to be less than the full trim out angle. After step 112, the method proceeds to step 114 where the method ends and restarts again at step 100.

Figure 9:
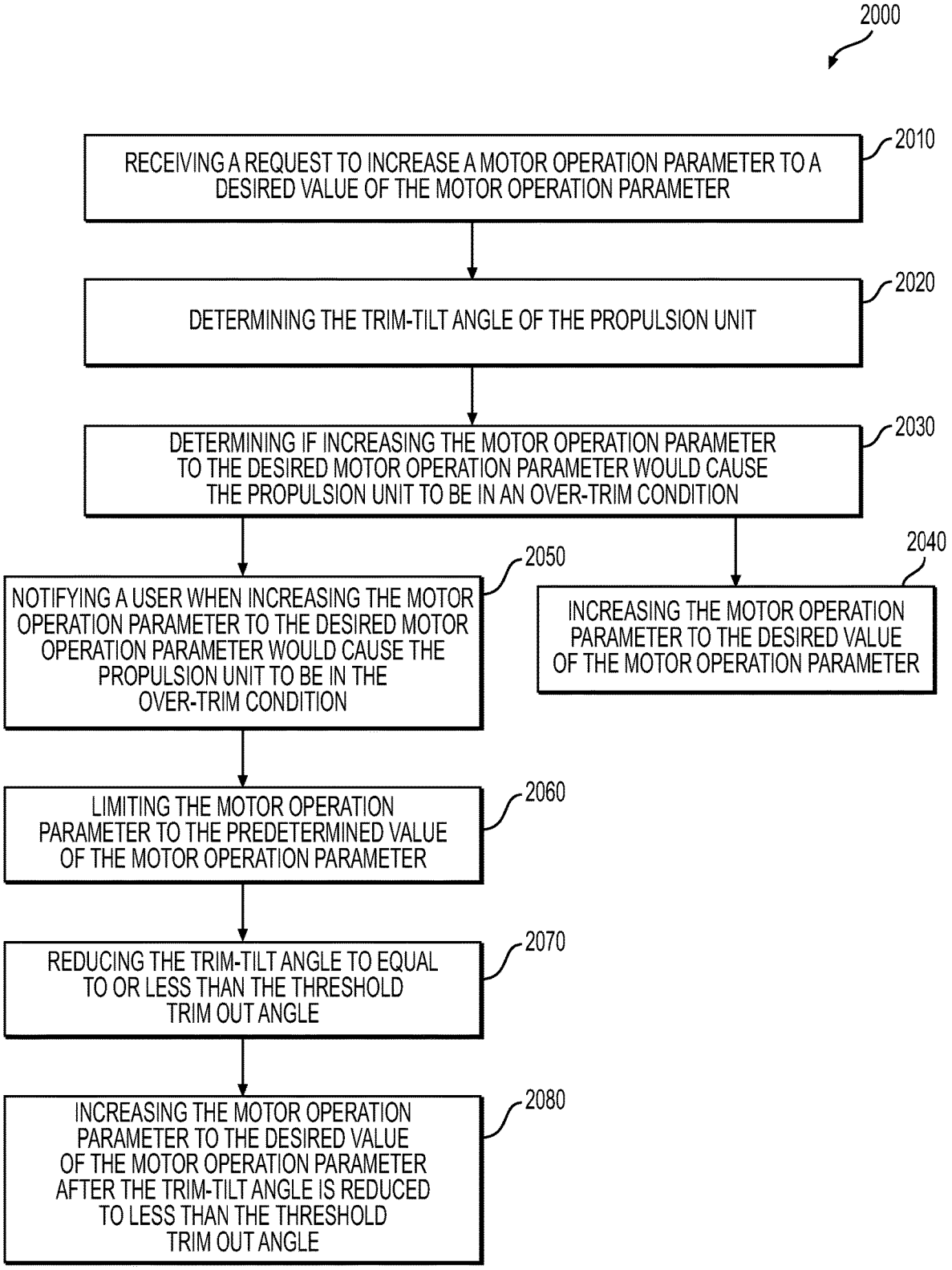
FIG. 9 is a flow diagram of another method for controlling the trim-tilt angle of the outboard motor of FIG. 1.

FIG. 9 illustrates a method 2000 in which the propulsion unit 40 is initially positioned such that the trim-tilt angle of the propulsion unit 40 is in the tilt range. At step 2010, the control unit 76 receives a request for increasing a motor operation parameter of the motor 36 to a desired value of the motor operation parameter. At step 2020, the control unit 76 determines the trim-tilt angle of the propulsion unit 40.

At step 2030, and prior to increasing the motor operation parameter to the desired value of the motor operation parameter in response to the request, the control unit 76 determines if increasing the motor operation parameter to the desired value of the motor operation parameter would cause the propulsion unit 40 to be in an over-trim condition. The over-trim condition is characterized by (i) the desired value of the motor operation parameter being greater than a predetermined value of the motor operation parameter, and (ii) the trim-tilt angle being equal to or greater than the threshold trim out angle of the propulsion unit 40. If these two conditions are met, then the control unit 76 determines that increasing the motor operation parameter to the desired value of the motor operation parameter would cause the propulsion unit 40 to be in the over-trim condition. Otherwise, the control unit 76 determines that increasing the motor operation parameter to the desired value of the motor operation parameter would not cause the propulsion unit 40 to be in the over-trim condition.

In this implementation, the threshold trim out angle of the propulsion unit 40 is 96.5% of the trim range, although other threshold trim out angles are contemplated. For example, in some implementations, the threshold trim out angle of the propulsion unit 40 is the full trim out angle of the propulsion unit 40.

In this implementation, the predetermined value of the motor operation parameter corresponds to a throttle request of the motor 36 of approximately 40% (±2%). It is contemplated that the predetermined value of the motor operation parameter can correspond to a throttle request of the motor 36 between 30% and 50% inclusively.

More specifically, in this implementation, the motor operation parameter of the motor 36 is a position of the throttle input device 89 and the predetermined value of the motor operation parameter is a predetermined position of the throttle input device 89. Therefore, in this implementation, the desired value of the motor operation parameter is communicated to the control unit 76 via a signal from the throttle input device position sensor 88 which senses the position of the throttle input device 89. Thus, in this implementation, the over-trim condition is characterized at least in part by the sensed position of the throttle input device 89 being greater than a predetermined position of the throttle input device 89. In other words, in order to determine that the propulsion unit 40 is in the over-trim condition, the control unit 76 determines if the sensed position of the throttle input device 89 is between the predetermined position of the throttle input device 89 and the full throttle position of the throttle input device 89. Thus, in this implementation, the predetermined position of the throttle input device 89 corresponds to a throttle request of the motor of approximately 40% (±2%). It is contemplated that the predetermined position of the throttle input device 89 can correspond to a throttle request of the motor 36 between 30% and 50% inclusively.

In other implementations, the motor operation parameter is the motor speed sensed from the motor speed sensor 84 rather than the position of the throttle input device 89. In such implementations, part of determining if the propulsion unit 40 is in the over-trim condition is to verify if the desired motor speed (RPM) is greater than a predetermined motor speed. It is contemplated that the predetermined motor speed can be between 1500 and 3000 rpm inclusively.

The motor operation parameter may be any other suitable motor operation parameter in other implementations. For example, in some implementations, the motor operation parameter may be a position of the throttle in the throttle body 86 as sensed by the throttle position sensor. When it is determined that increasing the motor operation parameter to the desired value of the motor operation parameter would not cause the propulsion unit to be in the over-trim condition, the method proceeds to step 2040. At step 2040, the control unit 76 increases the motor operation parameter to the desired value of the motor operation parameter.

However, if it is determined that increasing the motor operation parameter to the desired value of the motor operation parameter would cause the propulsion unit 40 to be in the over-trim condition, in this implementation, the method instead proceeds to step 2050. At the step 2050, the control unit 76 notifies a user of the outboard motor 10 when increasing the motor operation parameter to the desired value of the motor operation parameter would cause the propulsion unit 40 to be in the over-trim condition. More specifically, in this implementation, the control unit 76 causes a user interface of the watercraft 10 to display a notification alerting the user to the fact that increasing the motor operation parameter to the desired value of the motor operation parameter would cause the propulsion unit 40 to be in the over-trim condition. For example, the notification may be a symbol, a word, a color or other graphic element displayed on a screen (not shown) of the user interface. The notification may also consist of a lighting element (e.g., a bulb) of the user interface illuminating. Alternatively or additionally, the notification can be a sound played over a speaker (not shown) of the user interface. It is noted that the step 2050 could be optional.

The method then proceeds to step 2060 (or goes from step 2030 to step 2060 if the step 2050 is not implemented). At step 2060, the control unit 76 limits the motor operation parameter to the predetermined value of the motor operation parameter. That is, the control unit 76 prevents the motor operation parameter of the motor 36 to increase above the predetermined value of the motor operation parameter. Then, at step 2070, the control unit 76 controls the pump 70 and actuators 22, 26 to reduce the trim-tilt angle of the propulsion unit 40 to equal to or less than the threshold trim out angle of the propulsion unit 40 without user intervention. Once the trim-tilt angle has been reduced to less than the threshold trim out angle at step 2070, the control unit 76 then gradually increases the motor operation parameter to the desired value of the motor operation parameter at step 2080 thus fulfilling the initial request from step 2010.

Figure 10:
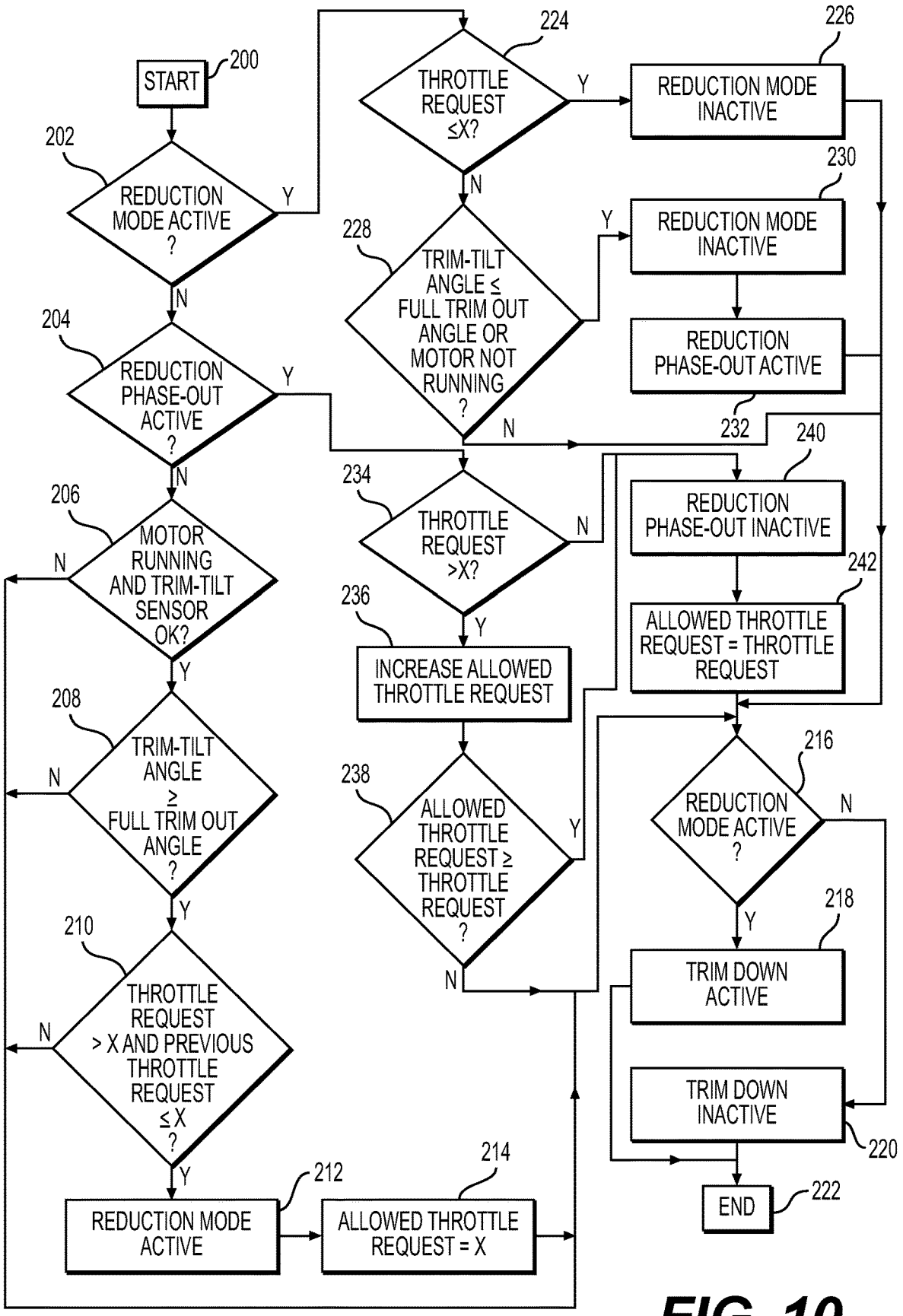
FIG. 10 is a logic diagram of an example of a detailed implementation of the method of FIG. 9.

FIG. 10 illustrates an example of a detailed implementation of the method of FIG. 9. The method illustrated in FIG. 10 starts at step 200. At step 202, the control unit 76 determines if a "reduction mode" is active. The reduction mode may have been activated during the previous run of the method and will be described below with respect to step 212. If the reduction mode is not active, the method proceeds to step 204 whereby the control unit 76 determines if a "reduction phase-out" of the control unit 76 has been activated. The reduction phase-out may have been activated during the previous run of the method and will be described below with respect to step 232. If the reduction phase-out is not active, the method proceeds to step 206, the control unit 76 determines if the motor 36 is running and the trim-tilt angle sensor is operational. If both conditions are met, the method proceeds at step 208 whereby the control unit 76 determines if the trim-tilt angle of the propulsion unit 40 is equal to or greater than the threshold trim out angle. If so, the method proceeds to step 210 whereby the control unit 76 determines if (i) the throttle request is greater than a predetermined throttle request, and (ii) the previously recorded throttle request is smaller than or equal to the predetermined throttle request value. If the determination at step 210 is affirmative, the method proceeds to step 212 whereby the reduction mode of the control unit 76 is activated. Then, at step 214, the control unit 76 sets a maximum allowed throttle request to the predetermined value of the throttle request. The method then proceeds to step 216 where the control unit 76 determines if the reduction mode is active. As in the present case it will be active, the method may proceed to step 218 instead of step 216. If at any of steps 206, 208 and 210, the respective determination is negative, the method proceeds to step 216.

If at step 202, it is determined that the reduction mode is already active, the method proceeds to step 224. At step 224, the control unit 76 determines if the current throttle request is less than or equal to the predetermined throttle request. If so, the method proceeds to step 226 whereby the reduction mode is deactivated. Subsequently, the method proceeds to step 216. If at step 224, the throttle request is determined to be greater than the predetermined throttle request, the method proceeds to step 228. At step 228, the control unit 76 determines if (i) the trim-tilt angle of the propulsion unit 40 is less than or equal to the threshold trim out angle (which is in this example is equal to the full trim out angle but could have any other value as discussed above), or (ii) if the motor 36 is not running. If either of these conditions is true, the method proceeds to step 230 where the reduction mode is deactivated. Subsequently, the method proceeds to step 232 where the reduction phase-out is activated. The reduction phase-out process is a process to increase the throttle request to a desired throttle request when the motor is running as will be described with respect to steps 234, 236, 238. From step 232, the method proceeds to the step 216. If at step 228, either of the conditions is determined to be negative, the method proceeds to the step 216.

If at step 204 the reduction phase-out is determined to be active, the method proceeds to step 234. At step 234, the control unit 76 determines if the throttle request is greater than the predetermined value of the throttle request. If yes, the method proceeds to step 236 where the control unit 76 increases the maximum allowed throttle request. In this implementation, the maximum allowed throttle request is increased by 5% every second. At subsequent step 238, the control unit 76 determines if the maximum allowed throttle request is greater than or equal to the actual throttle request. If it is not the case, the method proceeds to step 216 and will return to step 234. However, if it is the case, from step 228 the method proceeds to step 240. If at step 234 the throttle request is found not to be greater than the predetermined throttle request, the method proceeds to the step 240.

At the step 240, the reduction phase-out is deactivated. At the subsequent step 242, the maximum allowed throttle request is set to be free (i.e., equal to the actual throttle request). From there, the method proceeds to the step 216.

At the step 216, the control unit 76 determines if the reduction mode is active. If at step 216, the reduction mode is found to be active, the method proceeds to step 218. At the step 218, the trim down process is activated. That is, the pump 70, the actuator 26 and/or the actuator 22 are actuated without user intervention to reduce the trim-tilt angle of the propulsion unit 40. If the reduction mode is not active, the method proceeds to step 220 where the trim down process is deactivated. From steps 218 and 220, the method proceeds to step 222 where the method ends and restarts again at the step 200.

Figure 11:
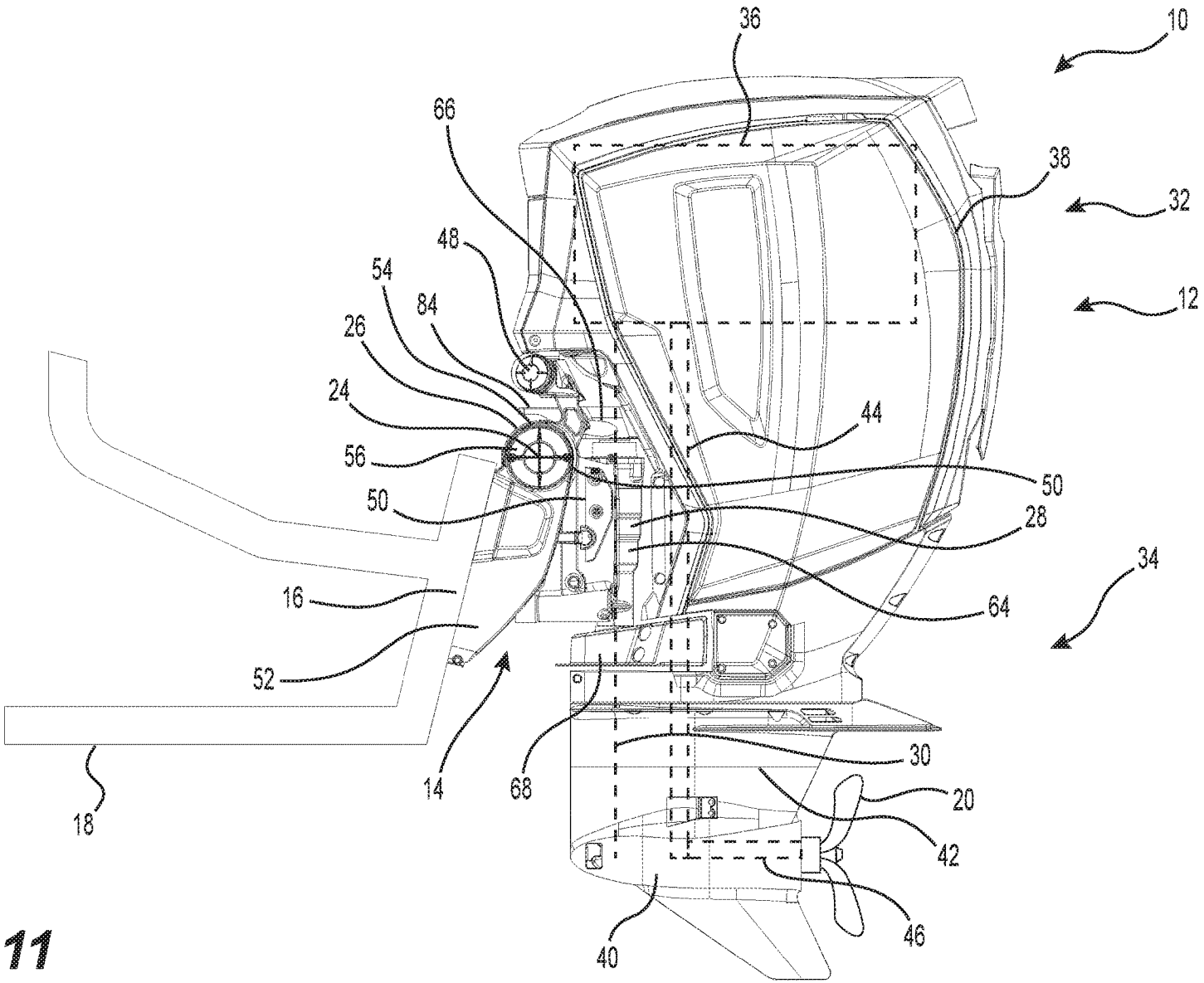
FIG. 11 is a left side elevation view of an alternative implementation of the outboard motor of FIG. 1.
Figure 12:
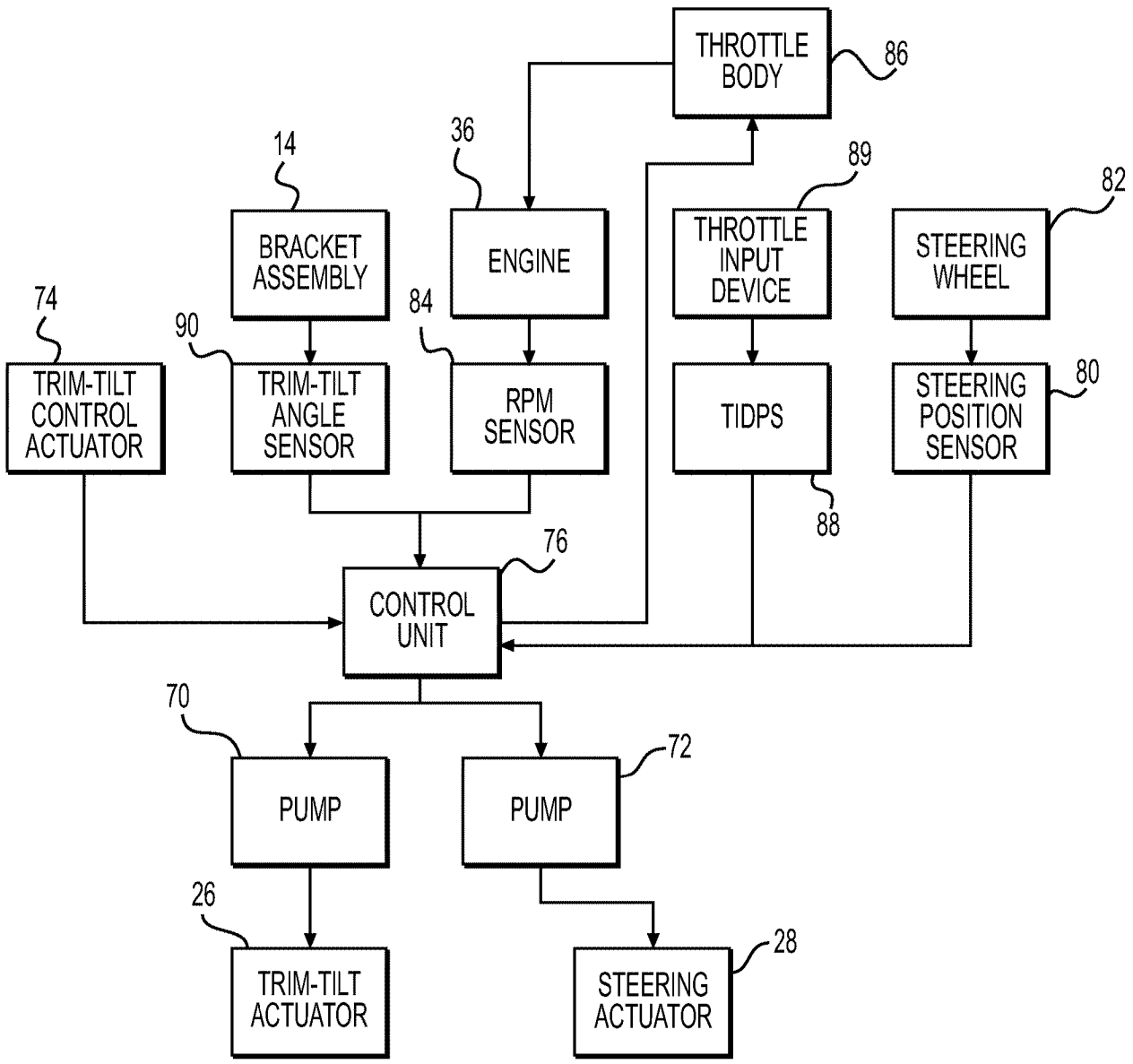
FIG. 12 is a schematic representation of various components of the outboard motor of FIG. 11.

While the outboard motor 10 has been described as having the linear actuators 22 and the rotary actuator 26, as mentioned above, the outboard motor 10 may be equipped with a single type of these actuators. For example, as shown in FIGS. 11 and 12, in alternative implementations, the outboard motor 10 has only the rotary actuator and no linear actuators. In yet other implementations, the outboard motor 10 has only the linear actuators 22 (or a single one of the linear actuators 22). In such implementations, the linear actuators 22 or the rotary actuator 26 are configured to modify the trim-tilt angle of the propulsion unit 40 from the full trim in position to the tilted out position (i.e., through the entire range of the trim-tilt angles).

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A method executed by an electronic control unit for controlling a trim-tilt angle of a propulsion unit of a marine outboard motor, the propulsion unit being driven by a motor of the marine outboard motor, the method comprising:

receiving a request to increase the trim-tilt angle of the propulsion unit;

determining the motor operation parameter of the motor;

determining the trim-tilt angle of the propulsion unit;

prior to increasing the trim-tilt angle in response to the request, determining if the propulsion unit is in a trim limit condition, the trim limit condition being characterized at least by both:

the determined motor operation parameter being greater than a predetermined value of the motor operation parameter; and the trim-tilt angle being equal to or greater than a threshold trim out angle of the propulsion unit; and in response to the request to increase the trim-tilt angle of the propulsion unit:

increasing the trim-tilt angle of the propulsion unit in response to the propulsion unit being determined not to be in the trim limit condition; and one of maintaining the trim-tilt angle of the propulsion unit and stopping increase of the trim-tilt angle of the propulsion unit in response to the propulsion unit being determined to be in the trim limit condition.

2. The method of claim 1, further comprising notifying a user of the outboard motor when the propulsion unit is in the trim limit condition.

3. The method of claim 2, wherein said notifying comprises displaying a notification on a user interface of a watercraft provided with the outboard motor.

4. The method of claim 1, wherein:

the motor operation parameter is a position of a throttle input device;

the predetermined value of the motor operation parameter is a predetermined position of the throttle input device;

determining the motor operation parameter comprises sensing the position of the throttle input device using a throttle input device position sensor.

5. The method of claim 4, wherein the predetermined position of the throttle input device corresponds to a throttle request of the motor between 30% and 50% inclusively.

6. The method of claim 1, wherein:

the motor operation parameter is a motor speed of the motor;

the predetermined value of the motor operation parameter is a predetermined motor speed;

determining the motor operation parameter comprises sensing the motor speed using a motor speed sensor.

7. The method of claim 6, wherein the predetermined motor speed is between 1500 and 3000 rpm inclusively.

8. The method of claim 1, wherein determining the trim-tilt angle comprises sensing the trim-tilt angle using a trim-tilt sensor.

9. The method of claim 1, wherein the threshold trim out angle is between 15° and 25° inclusively.

10. The method of claim 1, wherein the threshold trim out angle is a full trim out angle of the propulsion unit.

11. The method of claim 1, wherein receiving the request to increase the trim-tilt angle comprises receiving a signal from a trim-tilt control actuator indicative of a desired increase of the trim-tilt angle.

12. A method executed by an electronic control unit for controlling a trim-tilt angle of a propulsion unit of a marine outboard motor, the propulsion unit being driven by a motor of the marine outboard motor, the method comprising:

receiving a request to increase a motor operation parameter of the motor to a desired value of the motor operation parameter;

determining the trim-tilt angle of the propulsion unit;

prior to increasing the motor operation parameter to the desired value of the motor operation parameter in response to the request, determining if increasing the motor operation parameter to the desired value of the motor operation parameter would cause the propulsion unit to be in an over-trim condition, the over-trim condition being characterized at least by both:

the desired value of the motor operation parameter being greater than a predetermined value of the motor operation parameter; and the trim-tilt angle being equal to or greater than a threshold trim out angle of the propulsion unit;

in response to the request to increase the motor operation parameter and in response to it being determined that increasing the value of the motor operation parameter to the desired value of the motor operation parameter would cause the propulsion unit to be in the over-trim condition:

preventing the motor operation parameter from increasing above the predetermined value of the motor operation parameter;

reducing the trim-tilt angle of the propulsion unit to equal to or less than the threshold trim out angle of the propulsion unit; and increasing the motor operation parameter to the desired value of the motor operation parameter after the trim-tilt angle is reduced to less than the threshold trim out angle, in response to it being determined that increasing the motor operation parameter to the desired value of the motor operation parameter would not cause the propulsion unit to be in the over-trim condition, increasing the motor operation parameter to the desired value of the motor operation parameter in response to the request to increase the motor operation parameter.

13. The method of claim 12, further comprising notifying a user of the outboard motor when increasing the motor operation parameter to the desired value of the motor operation parameter would cause the propulsion to be in the over-trim condition.

14. The method of claim 13, wherein said notifying comprises displaying a notification on a user interface of a watercraft provided with the outboard motor.

15. The method of claim 12, wherein:

the motor operation parameter is a position of a throttle input device;

the predetermined value of the motor operation parameter is a predetermined position of the throttle input device; and receiving the request for increasing the motor operation parameter comprises sensing the position of the throttle input device using a throttle input device position sensor.

16. The method of claim 15, wherein the predetermined position of the throttle input device corresponds to a throttle request of the motor between 30% and 50% inclusively.

17. The method of claim 16, wherein the predetermined position of the throttle input device corresponds to a throttle request of approximately 40%.

18. The method of claim 12, wherein the motor operation parameter is a motor speed;

the desired value of the motor operation parameter is a desired motor speed; and the predetermined value of the motor operation parameter is a predetermined motor speed.

19. The method of claim 18, wherein the predetermined motor speed is between 1500 and 3000 rpm inclusively.

20. The method of claim 12, wherein determining the trim-tilt angle comprises sensing the trim-tilt angle using a trim-tilt sensor.

21. The method of claim 12, wherein the threshold trim out angle is between 15° and 25° inclusively.

22. The method of claim 12, wherein reducing the trim-tilt angle reduces the trim-tilt angle to less than the threshold trim out angle of the propulsion unit.

* * * * *